US008172224B2

(12) United States Patent
Kushida

(10) Patent No.: US 8,172,224 B2
(45) Date of Patent: May 8, 2012

(54) SHEET DISCHARGE APPARATUS, SHEET PROCESSING APPARATUS, AND IMAGE FORMING APPARATUS

(75) Inventor: Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 12/254,347

(22) Filed: Oct. 20, 2008

(65) Prior Publication Data

US 2009/0115129 A1 May 7, 2009

(30) Foreign Application Priority Data

Nov. 7, 2007 (JP) ..... 2007-289201

(51) Int. Cl.
*B65H 29/50* (2006.01)

(52) U.S. Cl. ..... 271/200; 271/314; 271/207

(58) Field of Classification Search ..... 271/200, 271/207, 314
See application file for complete search history.

(56) References Cited

U.S. PATENT DOCUMENTS 4,822,016 A * 4/1989 Sakuuchi et al. ..... 270/58.18
5,129,640 A * 7/1992 Kosaka et al. ..... 270/37
6,168,147 B1 1/2001 Nose et al. ..... 271/10.13
6,241,234 B1 6/2001 Saitoh et al. ..... 270/58.12
6,427,997 B1 * 8/2002 Hirota et al. ..... 270/58.12

FOREIGN PATENT DOCUMENTS

JP 10-181988 7/1998
JP 10-194569 7/1998

* cited by examiner

*Primary Examiner* — Michael McCullough

(74) *Attorney, Agent, or Firm* — Fitzpatrick, Cella, Harper & Scinto

(57) ABSTRACT

A configuration of a sheet discharge apparatus, a sheet processing apparatus, and an image forming apparatus has a lower discharge tray which stacks a sheet thereon; a pair of discharge rollers which discharge the sheets onto the lower discharge tray; and a changing unit (abutment member, eccentric cam, and discharge angle moving motor) which changes the discharge angle of the pair of discharge rollers, wherein the changing unit changes the discharge angle of the pair of discharge rollers such that a first discharge direction in a first discharge mode which discharges each sheet is closer to the lower discharge tray than a second discharge direction in a second discharge mode which discharges a plurality of overlapped sheets.

11 Claims, 24 Drawing Sheets

SHEET DISCHARGE APPARATUS, SHEET PROCESSING APPARATUS, AND IMAGE FORMING APPARATUS

BACKGROUND OF THE INVENTION

1. Field of the Invention

The present invention relates to a sheet discharge apparatus which sequentially discharges and stacks a sheet onto a stack tray, and a sheet processing apparatus and an image forming apparatus which have the sheet discharge apparatus.

2. Description of Related Art

A sheet processing apparatus in a related art which handles a sheet, such as a stapling device which staples a sheet bundle and a punching device which punches the sheet bundle, has a stack tray which sequentially stacks the sheet thereonto, and a discharge roller which discharges the sheet onto the stack tray (see Patent Documents 1 and 2 (Japanese Patent Application Laid-Open Nos. 10-181988 and 10-194569)).

FIG. 24 is a block diagram of a discharge portion of the sheet processing apparatus in Patent Documents 1 and 2. As illustrated in FIG. 24, the sheet processing apparatus in the related art has a pair of conveying rollers 1007 (a conveying roller 1007*a* and a conveying roller 1007*b*), a processing tray 1130, and a stack tray 1200. The sheet processing apparatus has a pair of left and right aligning members 1140 in the sheet width direction, a pair of discharge rollers 1180, a swinging guide 1150, and a drawing-in paddle 1160.

The pair of conveying rollers 1007 convey a sheet S from an upstream conveying path. The processing tray 1130 receives the conveyed sheet S. The stack tray 1200 stacks the processed and discharged sheet bundle thereonto.

Roulette belts are wound around the lower conveying roller 1007*a* of the pair of conveying rollers 1007 in several positions in the axial direction between the lower conveying roller 1007*a* and the conveying roller 1007*b*. A sheet guide is arranged in an appropriate position between the roulette belts.

The downstream side (or the upper left side in the drawing) in the discharge direction of the sheet S of the processing tray 1130 is inclined upward, and the upstream side (or the lower right side in the drawing) thereof is inclined downward. A trailing end stopper 1131 is provided at an upstream end of the processing tray 1130. The pair of discharge rollers 1180 (bundle discharge rollers 1180*a* and 1180*b*) are arranged on the downstream side of the processing tray 1130. The swinging guide 1150 has the upper bundle discharge roller 1180*b* on the lower surface at its end, and supports the upper bundle discharge roller 1180*b* so as to bring it into contact with or bring it out of contact with the lower bundle discharge roller 1180*a*. The drawing-in paddle 1160 is disposed above an intermediate portion.

The discharged sheet S is started to move to the trailing end stopper 1131 by its own weight. The paddle 1160 which has stopped in the home position is rotated counterclockwise to promote movement of the sheet. The trailing end of the sheet S is reliably abutted on the stopper 1131 and is then stopped. Rotation of the paddle 1160 is also stopped. The sheet is aligned by the aligning member 1140.

All the sheets of a first bundle are discharged onto the processing tray 1130 and are then aligned. The swinging guide 1150 is lowered so that the roller 1180*b* rides on the sheet bundle. The sheet bundle is stapled by a stapler which is on standby on the trailing end stopper 1131 and is then discharged onto the stack tray 1200.

During that time, a sheet S1 discharged from an image forming apparatus body is wound around a large conveying roller provided in the upstream portion of the processing tray 1130. Up to three sheets are reserved so as not to convey other sheets to the processing tray 1130.

Three sheets S2 in the large conveying roller portion directly pass through the upstream conveying path and are then conveyed to the processing tray 1130. The lowered swinging guide 1150 receives the three sheets S2 by the rollers 1180*a* and 1180*b*. After the trailing ends of the sheets S2 have passed through the pair of conveying rollers 1007, the rollers 1180*a* and 1180*b* are reversely rotated. Before the trailing end of the sheet S2 is abutted on the stopper 1131, the swinging guide 1150 is raised so that the roller 1180*b* is brought out of contact with the surface of the sheet. Like the operation of the first bundle, the fourth sheet or later passes though the upstream conveying path and is then discharged onto the processing tray in the state that the swinging guide 1150 is opened. The third bundle or later is aligned by the same operation as that of the second bundle. A set number of bundles are stacked onto the stack tray 1200 for end.

The bundle return angle of the pair of discharge rollers 1180 is slightly larger than the angle of the processing tray 1130 relative to the horizontal plane. The three overlapped sheets are abutted on the lower portion of the stopper 1131 to prevent sheet buckling. Any curled sheets can be easily aligned.

In Patent Document 2, in a sort process in a non-stapling mode, a small number of sheets (or two to five sheets) for one bundle are stacked and aligned on the processing tray 1130 to discharge the bundle onto the stack tray 1200. The stacking properties on the stack tray 1200 can be improved.

In Patent Documents 1 and 2, when the sheets stacked on the inclined processing tray are discharged by the bundle discharge rollers, the angle of the conveying direction (or the nip angle) of the bundle discharge rollers is typically slightly larger (1 to 2°) than the angle of the processing tray. The angle of the processing tray typically has an inclination of approximately 35° relative to the horizontal plane in consideration of the sheet aligning properties and shortening of time required for alignment. The sheet is reversely conveyed from the bundle discharge rollers in the direction of the trailing end stopper so as to follow the surface of the processing tray. In consideration of the aligning properties, the discharge and stacking time, and the stacking shape, the stack tray is set to an angle slightly closer to the horizontal plane than the processing tray (or approximately 30° relative to the horizontal plane in the related art).

The sheet discharge direction is larger than 25° relative to the horizontal plane in consideration of the basis weight (ream weight) of the sheet, the use environment, and the curled state.

When the angle of the discharge direction is larger than the angle of the stack tray, there has been known that the discharge properties are deteriorated due to floating of the leading end of the sheet by air resistance and unstability of the posture at discharge and falling. To perform stable discharge, the discharge portion typically sets the angle of the discharge direction to 20 to 22° relative to the horizontal plane, and brings the leading end of the sheet into contact with the surface of the stack tray before the trailing end of the sheet passes through the discharge nip portion to perform stable discharge control. The stability when each sheet is discharged can be maintained. When the sheet bundle is discharged, the weight applied to the leading ends of the sheets is increased to push out the stacked sheet. The discharge of the sheet bundle of a large number of sheets can block the discharge port.

In Patent Document 2, the sheet is discharged at an angle larger than the inclination angle of the stack tray (35°). After the trailing end of the sheet has passed through the nip between the bundle discharge rollers, the posture at discharge and falling onto the stack tray can be unstable. In consideration of this, the bundle of a small number of overlapped sheets is always discharged to increase the weight of the discharged sheet bundle, thereby improving the discharge stability.

The angle of the discharge direction is large (approximately 35 to 36°). A small number of light and thin sheets or a small number of sheets with the leading end curled upward are overlapped, resulting in stacking failure. In consideration of the floating of the leading end of the sheet at discharge and the unstability of discharge and falling properties, increase of the discharge speed is limited. A bundle of a plurality of sheets which have been always stacked once on the processing tray 1130 is discharged. The stacking and aligning processes on the processing tray during the interval of sheet conveying need to be completed. Faster discharge is thus difficult.

The present invention provides a sheet discharge apparatus, a sheet processing apparatus, and an image forming apparatus, which can improve the aligning and stacking properties and cope with a wide range of types and sizes of sheets and higher speed.

SUMMARY OF THE INVENTION

To solve the above problems, the representative configuration of a sheet discharge apparatus, a sheet processing apparatus, and an image forming apparatus according to the present invention includes: a stack tray which stacks a sheet thereon; a discharging member which discharges the sheet onto the stack tray; and a changing unit which changes the discharge angle of the discharging member, wherein the changing unit changes the discharge angle of the discharging member such that a first discharge direction in a first discharge mode which discharges each sheet is closer to the stack tray than a second discharge direction in a second discharge mode which discharges a plurality of overlapped sheets.

According to the present invention, the aligning and stacking properties can be improved, and a wide range of types and sizes of sheets and higher speed can be coped with.

Further features of the present invention will become apparent from the following description of exemplary embodiments (with reference to the attached drawings).

DETAILED DESCRIPTION OF THE PREFERRED EMBODIMENTS

<The Overall Configuration of an Image Forming Apparatus>

Figure 1:
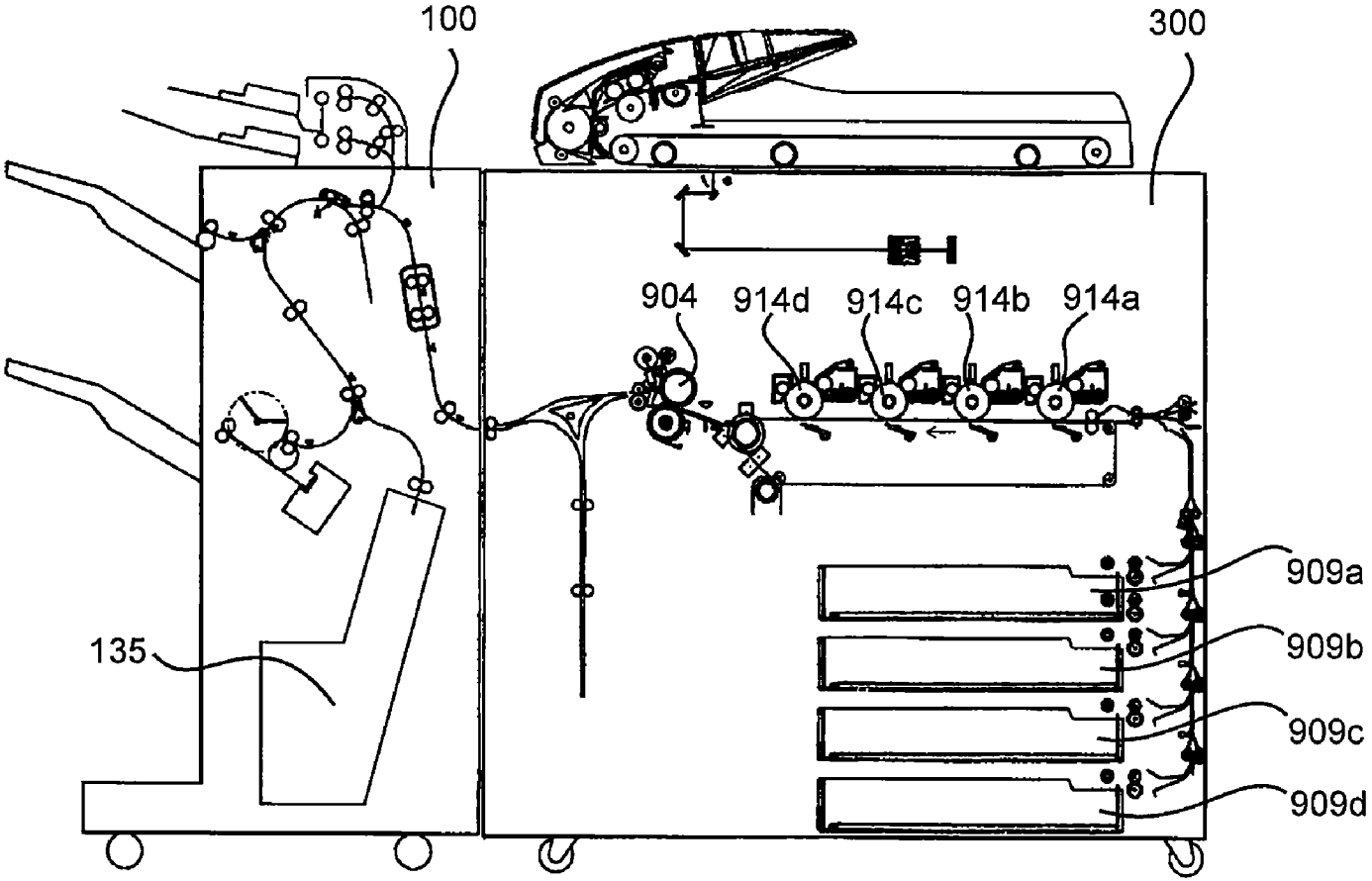
FIG. 1 is a block diagram of an image forming apparatus according to this embodiment.

FIG. 1 is a block diagram of an image forming apparatus. As illustrated in FIG. 1, the image forming apparatus has an image forming apparatus body 300 which performs monochrome/color image formation, and a finisher 100 which is a sheet processing apparatus connected thereto. The finisher 100 has a saddle stitching processing unit (or a saddle unit) 135, and a side stitching processing apparatus as a sheet discharge apparatus. A sheet discharged from the image forming apparatus body 300 can be processed online. The finisher 100 can be used as an option. The image forming apparatus body 300 can be used alone. The finisher 100 may be incorporated as the sheet discharge apparatus into the image forming apparatus body 300. A position where the user faces an operation portion 301 (FIG. 19) to perform various inputs/settings to the image forming apparatus body 300 is called the front side of the image forming apparatus (hereinafter, the front side) and the back side of the apparatus is called the back side. FIG. 1 illustrates the configuration of the image forming apparatus seen from the front side of the apparatus. The finisher 100 is connected to the side of the image forming apparatus body 300.

Toner images of four colors are transferred onto a sheet supplied from each of cassettes 909*a* to 909*d* in the image forming apparatus body 300 by photosensitive drums 914*a* to 914*d* of yellow, magenta, cyan, and black making up the image forming portion. The sheet onto which the toner images are transferred is conveyed to a fixing device 904 to fix the toner images and is then discharged to the outside the apparatus.

<Sheet Processing Apparatus>

Figure 2:
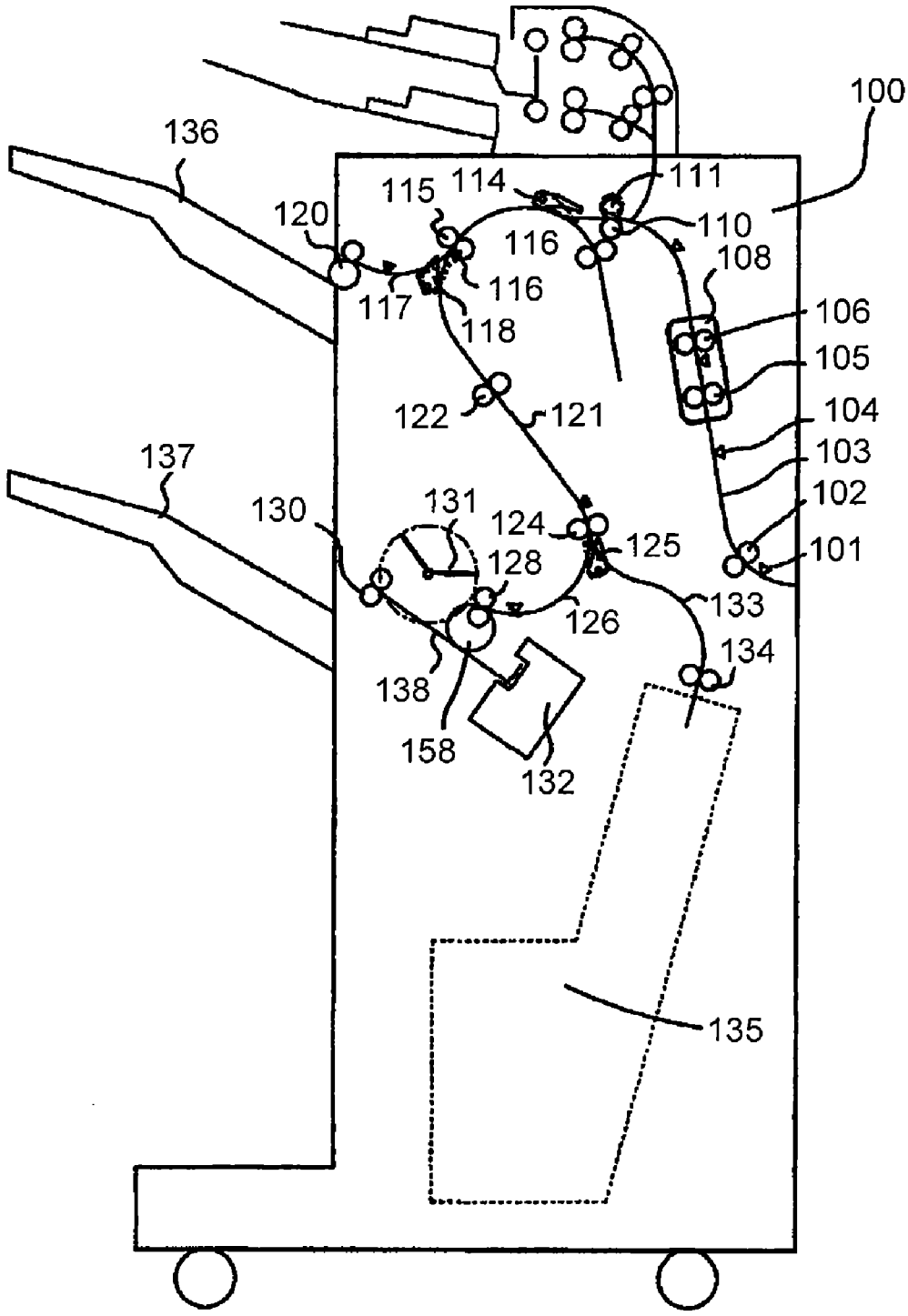
FIG. 2 is a block diagram of a sheet processing apparatus.

FIG. 2 is a block diagram of the finisher 100 as the sheet processing apparatus. As illustrated in FIG. 2, a sheet discharged from the image forming apparatus body 300 is received by a pair of inlet rollers 102 of the finisher 100. The receiving timing of the sheet is detected by an inlet sensor 101 at the same time. The sheet conveyed by the pair of inlet rollers 102 passes through a conveying path 103. During that time, the end position of the sheet is detected by a lateral registration detecting sensor 104. The degree of a lateral registration error from the center position of the sheet processing apparatus is detected.

After the lateral registration error has been detected, a shift unit 108 is moved by a predetermined amount in the front/back directions while the sheet is conveyed to a pair of shift rollers 105 and 106, thereby performing the shift operation of the sheet. The shift operation will be described later in detail.

The sheet conveyed by a conveying roller 110 and a non-contacting roller 111 is conveyed by a pair of buffer rollers 115. When the sheet is discharged onto an upper discharge tray 136, an upper path switching member 118 is brought into the state indicated by the dashed line in the drawing by a driving member such as a solenoid, not illustrated. The sheet is guided to an upper path conveying path 117 and is then discharged onto the upper discharge tray 136 by an upper discharge roller 120.

When the sheet is not discharged onto the upper discharge tray 136, the sheet conveyed by the pair of buffer rollers 115 is guided to a bundle conveying path 121 by the upper path switching member 118. The sheet sequentially passes in the conveying path by a pair of buffer rollers 122 and a pair of bundle conveying rollers 124. When the sheet is saddle stitched, a saddle path switching member 125 is brought into the state indicated by the dashed line by the driving member such as the solenoid, not illustrated. The sheet is conveyed to the saddle path 133, is guided to the saddle unit 135 by a pair of saddle inlet rollers 134, and is saddle stitched.

When a conveyed sheet S is discharged onto a lower discharge tray (or a stack tray) 137, the sheet conveyed to the pair of bundle conveying rollers 124 is conveyed to a lower path 126 by the saddle path switching member 125. A plurality of the sheets discharged onto an intermediate processing tray 138 (or a second stack tray) by a pair of lower discharge rollers (or conveying members) 128 are overlapped and processed in the intermediate processing tray 138 and are then discharged onto the lower discharge tray 137 by a pair of discharge rollers (discharging members) 130. The sheet process in the intermediate processing tray 138 will be described later in detail.

<Description of the Shift Unit>

Figure 6:
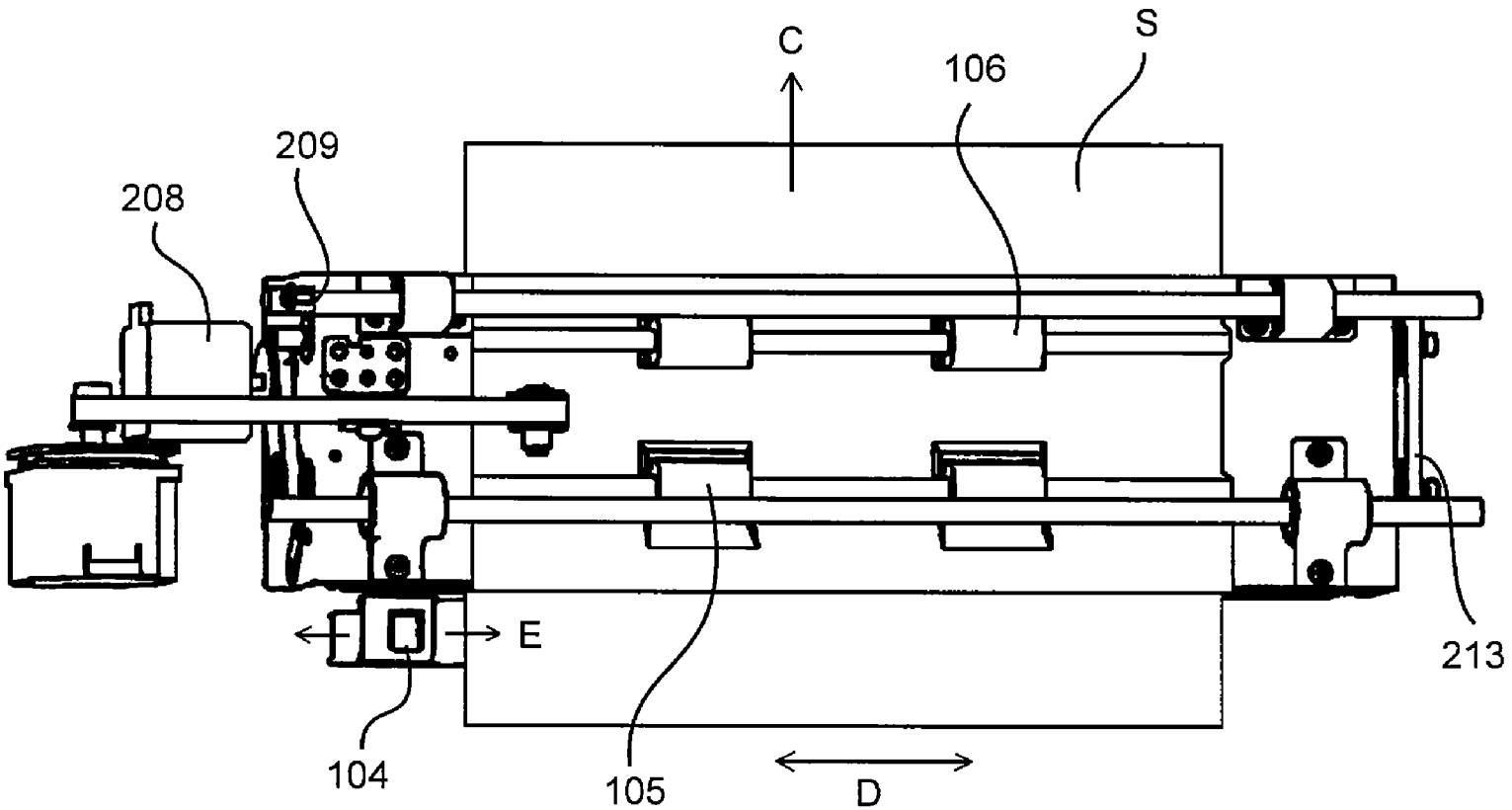
FIG. 6 is a front view of a shift unit.
Figure 7:
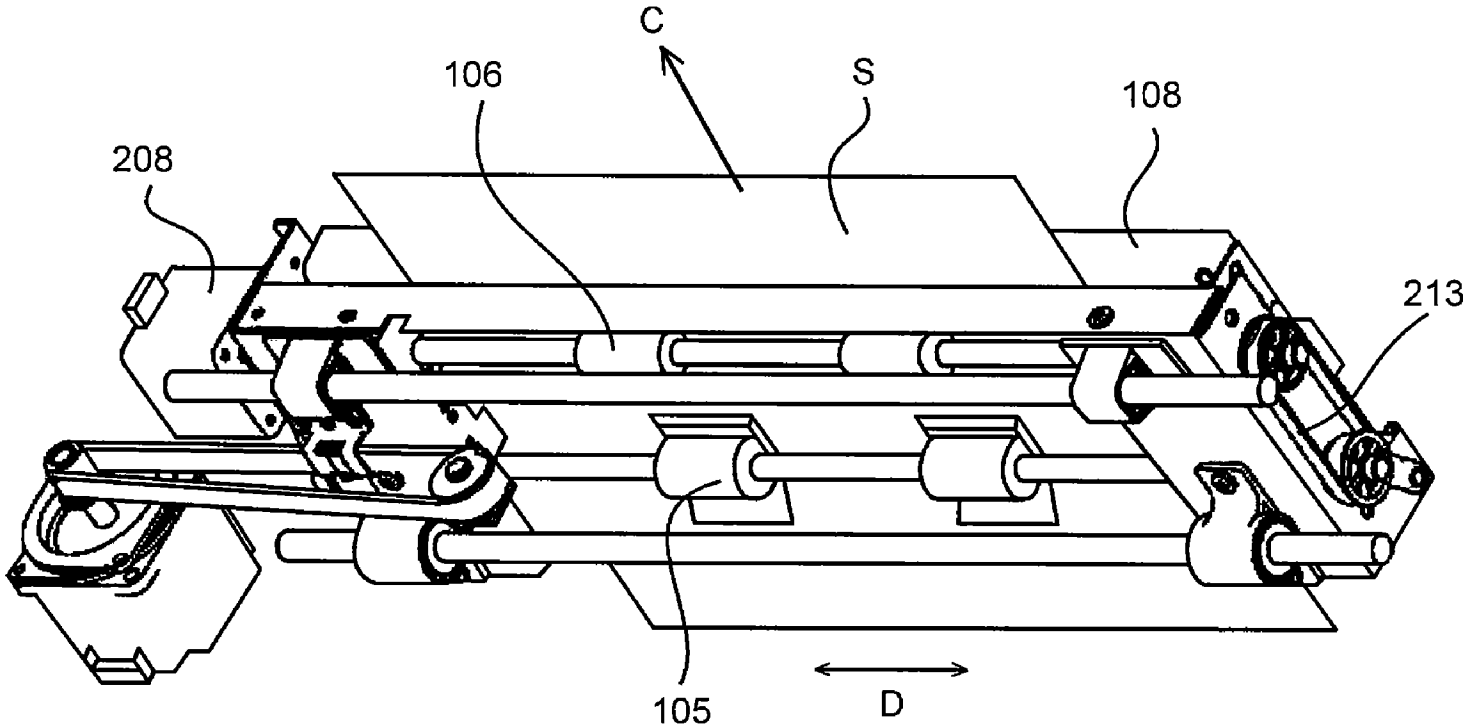
FIG. 7 is a perspective view of the shift unit.

The configuration and operation of the shift unit 108 will be described by FIGS. 6 and 7. FIG. 6 is a front view of the shift unit. FIG. 7 is a perspective view of the shift unit.

As illustrated in FIGS. 6 and 7, for the conveyed sheet S, the driving of a shift conveying motor 208 is transmitted to a driving belt 209 to drive the pair of shift rollers 105. The pair of shift rollers 106 are driven by a driving belt 213. The sheet S is conveyed in the C direction in the drawing. The lateral registration detecting sensor 104 is moved in the direction of the arrows E by the driving member, not illustrated, to detect the position of the sheet S. The conveying sheet is moved by the amount of shift of the sheet obtained by adding the amount of movement which cancels the lateral registration error and the set amount of shift of the sheet. The operation is performed in the front/back directions (indicated by the double-headed arrow D) when the sheet S is nipped between the pair of shift rollers 105 and 106. The sheet S can thus be shifted by a predetermined amount while being conveyed in the conveying direction C.

<Description of the Operation of a Buffering Process>

To perform the stapling process and the saddle process, a fixed processing time is typically required. Typically, it is difficult to complete the processes during the interval of sheet discharge. The processing time exceeds the interval of sheet discharge. The processing time depends on the image forming speed of the image processing apparatus. A sheet buffering process method which performs the sheet process without stopping image formation of the image forming apparatus has been widely known. The sheet buffering process will be described below.

Figure 3:
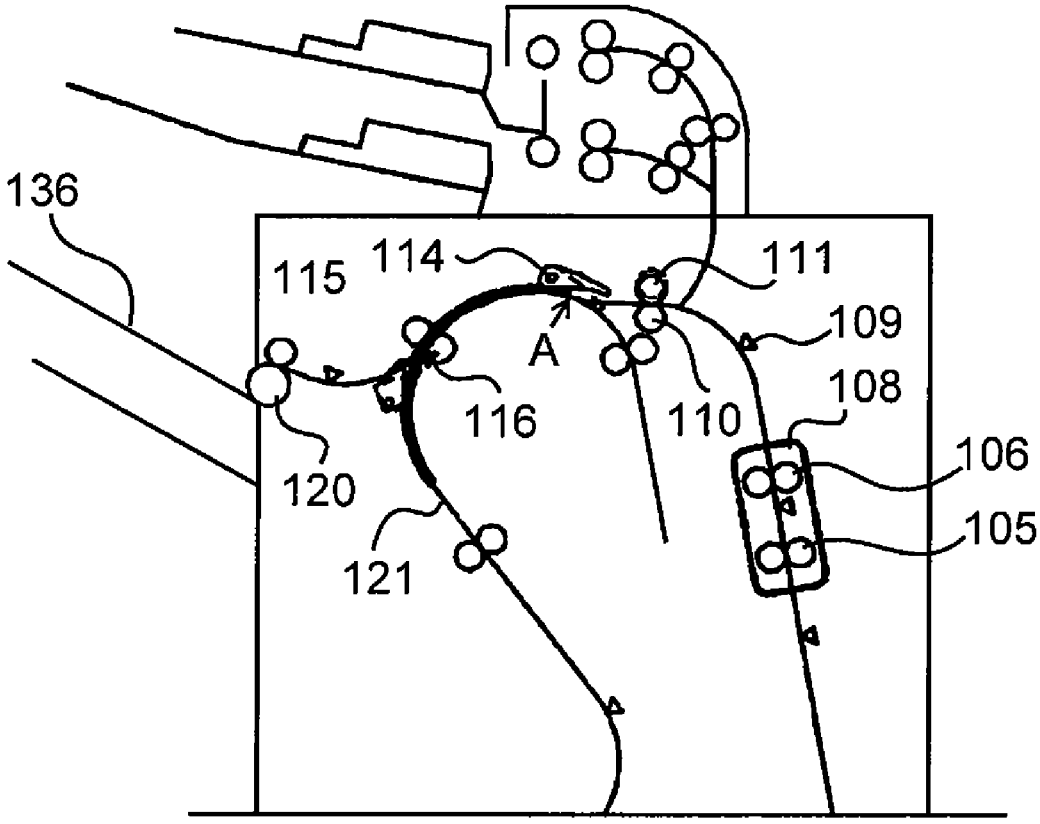
FIG. 3 is a cross-sectional view describing the operation of the sheet processing apparatus.

As illustrated in FIG. 3, a sheet S1 conveyed by the conveying roller 110 and the non-contacting roller 111 is guided to the bundle conveying path 121 by the pair of buffer rollers 115. The leading end of the sheet S1 is detected by a buffer sensor 116. The pair of buffer rollers 115 perform stop control by the driving member, not illustrated, from the identified sheet size information, so as to stop the sheet when the trailing end position of the sheet reaches a position A.

Figure 4:
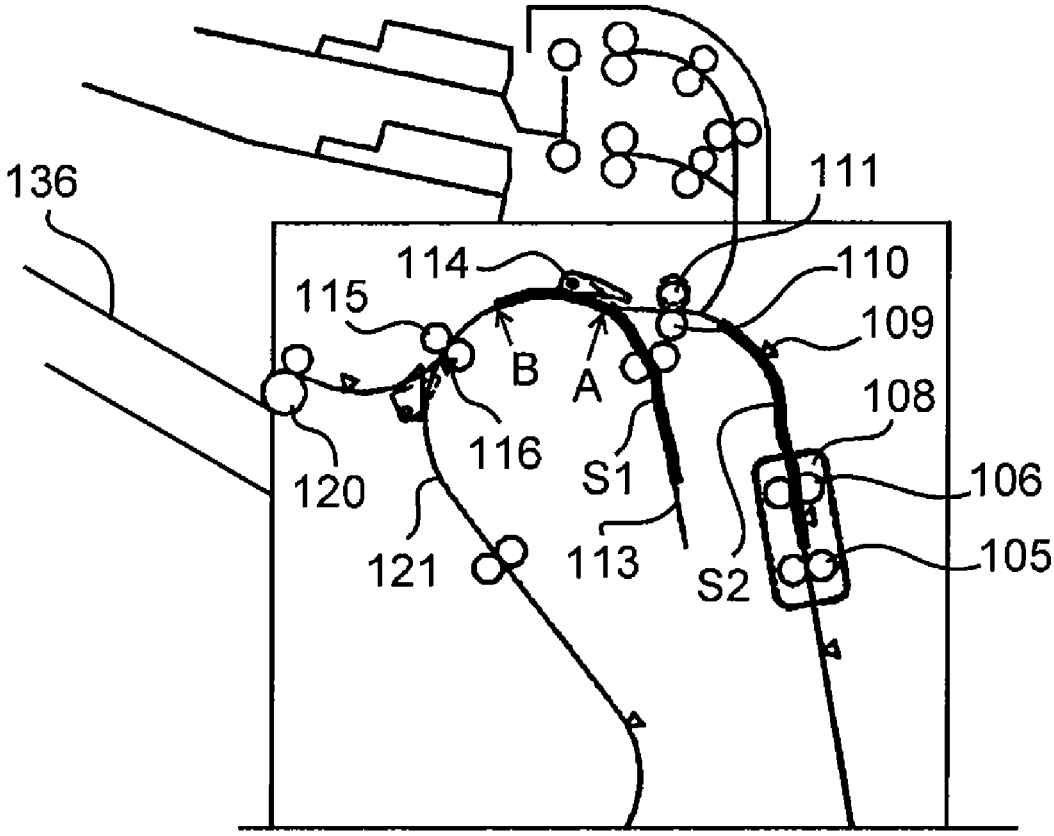
FIG. 4 is a cross-sectional view describing the operation of the sheet processing apparatus.

As illustrated in FIG. 4, a buffer path switching member 114 is brought into the state indicated by the dashed line by the driving member such as the solenoid, not illustrated. The pair of buffer rollers 115 perform the reverse rotation operation. The trailing end of the sheet is guided to a buffer path 113. The sheet S1 is reversely conveyed until the leading end of the sheet is moved to a position B.

Figure 5:
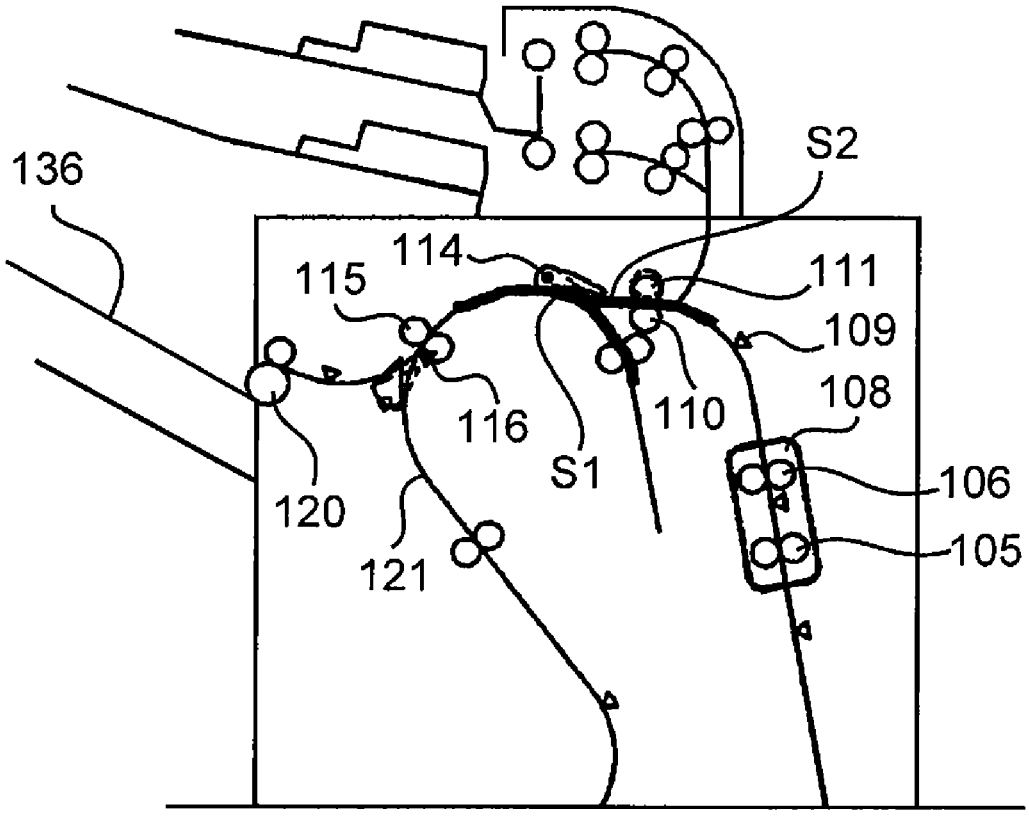
FIG. 5 is a cross-sectional view describing the operation of the sheet processing apparatus.

As illustrated in FIG. 5, the leading end of a sheet S2 conveyed following the sheet S1 is detected by a buffer sensor 109. The pair of buffer rollers 115 are started to drive such that the stopped sheet S1 is located in the same position as that of the leading end of the sheet S2 in the state that the conveying speed is reached. The leading ends of sheets S1 and S2 are aligned.

When another sheet is overlapped, the pair of buffer rollers 115 are driven until the trailing end positions of the sheets S1 and S2 reach the A point. The above process is repeated so that another sheet can be overlapped.

A bundle of a predetermined number of overlapped sheets is conveyed to the intermediate processing tray 138 or the saddle unit 135 by the pair of buffer rollers 122 and a pair of bundle conveying rollers 123 on the downstream.

<The Intermediate Processing Tray 138>

The intermediate processing tray 138 will be described using FIGS. 8 to 12.

Figure 8:
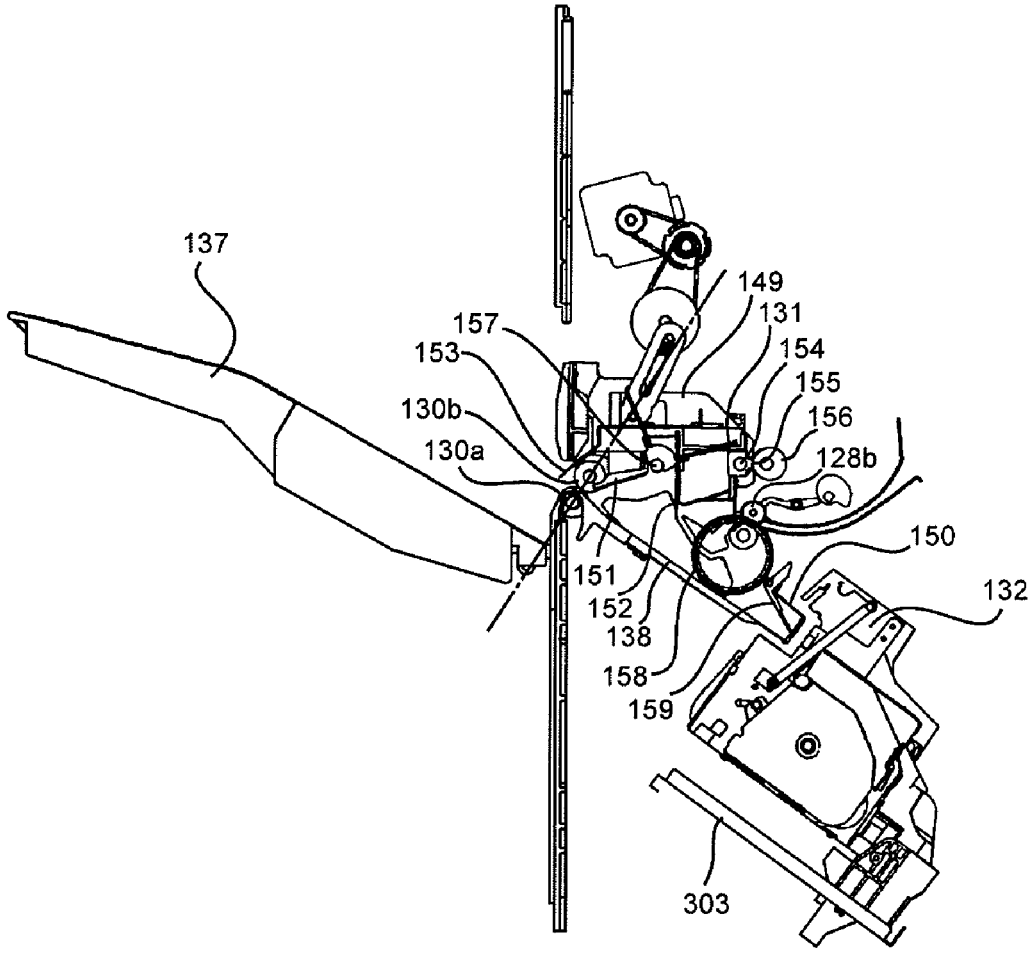
FIG. 8 is a cross-sectional view describing an intermediate processing tray.

As illustrated in FIG. 8, the downstream side (or the left side of FIG. 8) in the discharge direction of a sheet bundle of the intermediate processing tray 138 as the second stack tray is inclined upward, and the upstream side (or the right side of FIG. 8) thereof is inclined downward. A trailing end stopper 150 is arranged at the lower end on the upstream side of the intermediate processing tray 138. The trailing end stopper 150 has a plurality of stopper portions 150*a*, 150*b*, 150*c*, and 150*d*.

An upper discharge roller 130*b* of the pair of discharge rollers 130 is arranged at the upper end on the downstream side of the intermediate processing tray 138. The upper discharge roller 130*b* of the pair of discharge rollers 130 is arranged at the front end of the lower surface of a swinging guide 149. The upper discharge roller 130*b* is brought into contact with or is brought out of contact with a lower discharge roller 130*a* along with the opening and closing operation of the swinging guide 149. The upper and lower discharge roller shaft portions of the pair of discharge rollers 130 are rotated and driven by a driving motor M130 which is a driving member. The pair of discharge rollers 130 are rotated forward and reversely. The pair of discharge rollers 130 can discharge and convey a sheet in the discharge direction which discharges the sheet onto the lower discharge tray 137 and in the conveying direction which conveys the sheet onto the intermediate processing tray 138.

A guide 151, a first charge removal needle 152, and a second charge removal needle 153 are arranged on the swinging guide 149 in the axial direction, respectively. The swinging guide 149 is rotatably supported by a support shaft 154 and can be moved upward and downward.

The guide 151 is provided on the upstream side in the sheet conveying direction of the upper discharge roller 130*b* and guides the sheet to the nip portion between the pair of discharge rollers 130. The first charge removal needle 152 is a charge removal member which removes a charged electrical potential on the surface of the sheet when the sheet is discharged from the lower discharge roller 128 into the intermediate processing tray 138. The second charge removal needle 153 is provided on the downstream side in the sheet conveying direction of the upper discharge roller 130*b* and is a charge removal member which removes a charged electrical potential on the surface of the sheet discharged from the pair of discharge rollers 130.

Figure 11:
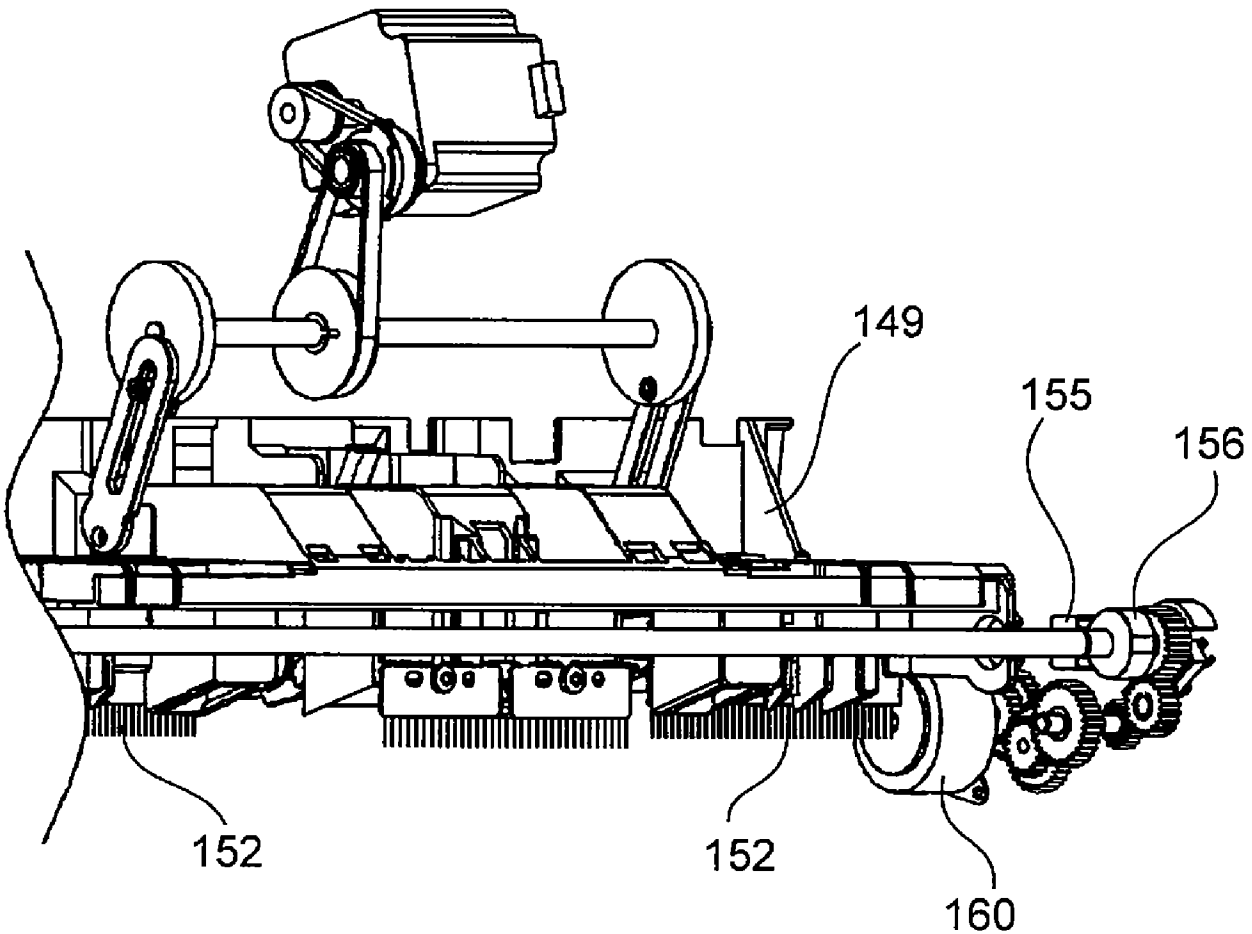
FIG. 11 is a block diagram describing a swinging guide.

An abutment member 155 arranged coaxially of the support shaft 154 is housed so as to be movable in a slider and is supported so as to be always abutted on an eccentric cam 156 by an urging spring, not illustrated. As illustrated in FIG. 11, the eccentric cam 156 can be rotated by a discharge angle moving motor 160. The abutment member 155 is moved in the slider together with the support shaft 154 by the rotational position of the eccentric cam 156 and moves the swinging guide 149. The abutment member 155, the eccentric cam 156, and the discharge angle moving motor 160 configure a changing unit.

By the operation of the changing unit, the roller nip position formed by the upper discharge roller 130*b* and the lower discharge roller 130*a* is moved on the outer circumferential circle of the lower discharge roller 130*a* to vary the discharge angle of the pair of discharge rollers 130. In a series of operation of the swinging guide 149, the accompanying guide 151, first charge removal needle 152, and second charge removal needle 153 are moved as in the operation of the swinging guide 149. The arrangement relation between the swinging guide 149, the charge removal needles 152 and 153, and the upper discharge roller 130*b* can be always unchanged.

Figure 9:
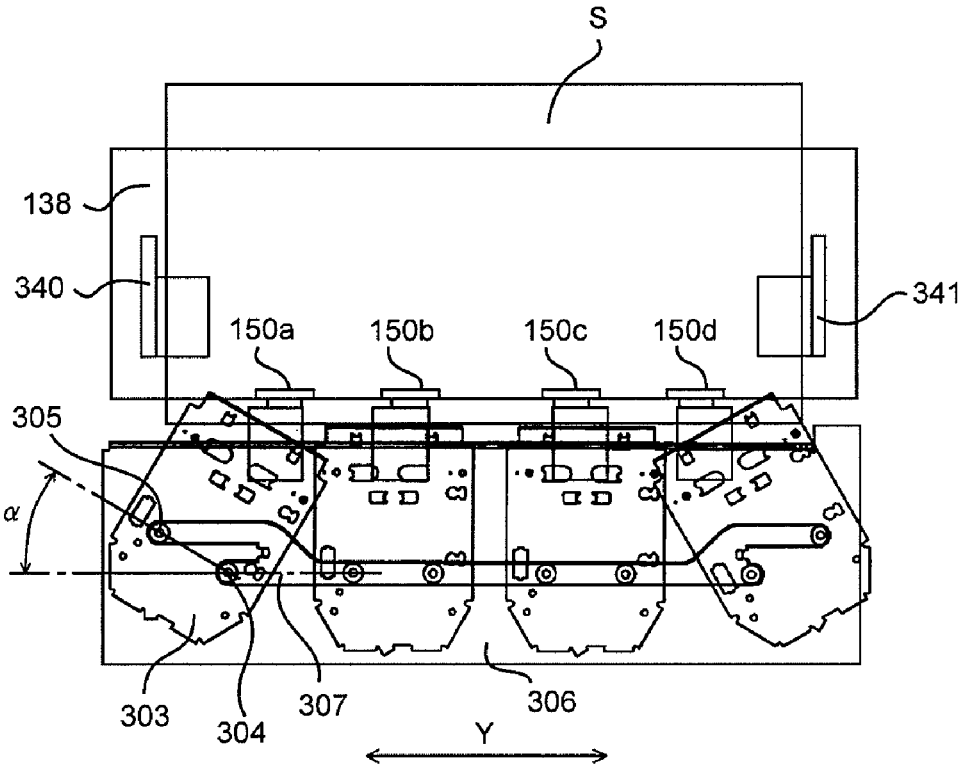
FIG. 9 is a top view describing a stapling portion.

A stapler 132 as the sheet processing member is fixed on a slide support base 303. The stapler 132 and the slide support base 303 make up the sheet processing portion. As illustrated in FIG. 9, rolls 304 and 305 are provided in the lower portion of the slide support base 303. The slide support base 303 is guided by the rolls 304 and 305 and a guide rail groove 307 on a stapler moving base 306 and is moved along the trailing end of the sheet S stacked on the intermediate processing tray 138 (or in the direction of the double-headed arrow Y).

The stapler 132 is maintained so as to be inclined by a predetermined angle $\alpha$ relative to the trailing end of the sheet in the corner of the sheet S stacked on the intermediate processing tray 138. The angle of inclination $\alpha$ is set to approximately 30° and can be changed by changing the shape of the guide rail groove 307. A position sensor, not illustrated, which detects the home position of the stapler 132 is provided on the stapler moving base 306. The stapler 132 is typically on standby in the home position on the front side of the apparatus.

Figure 10:
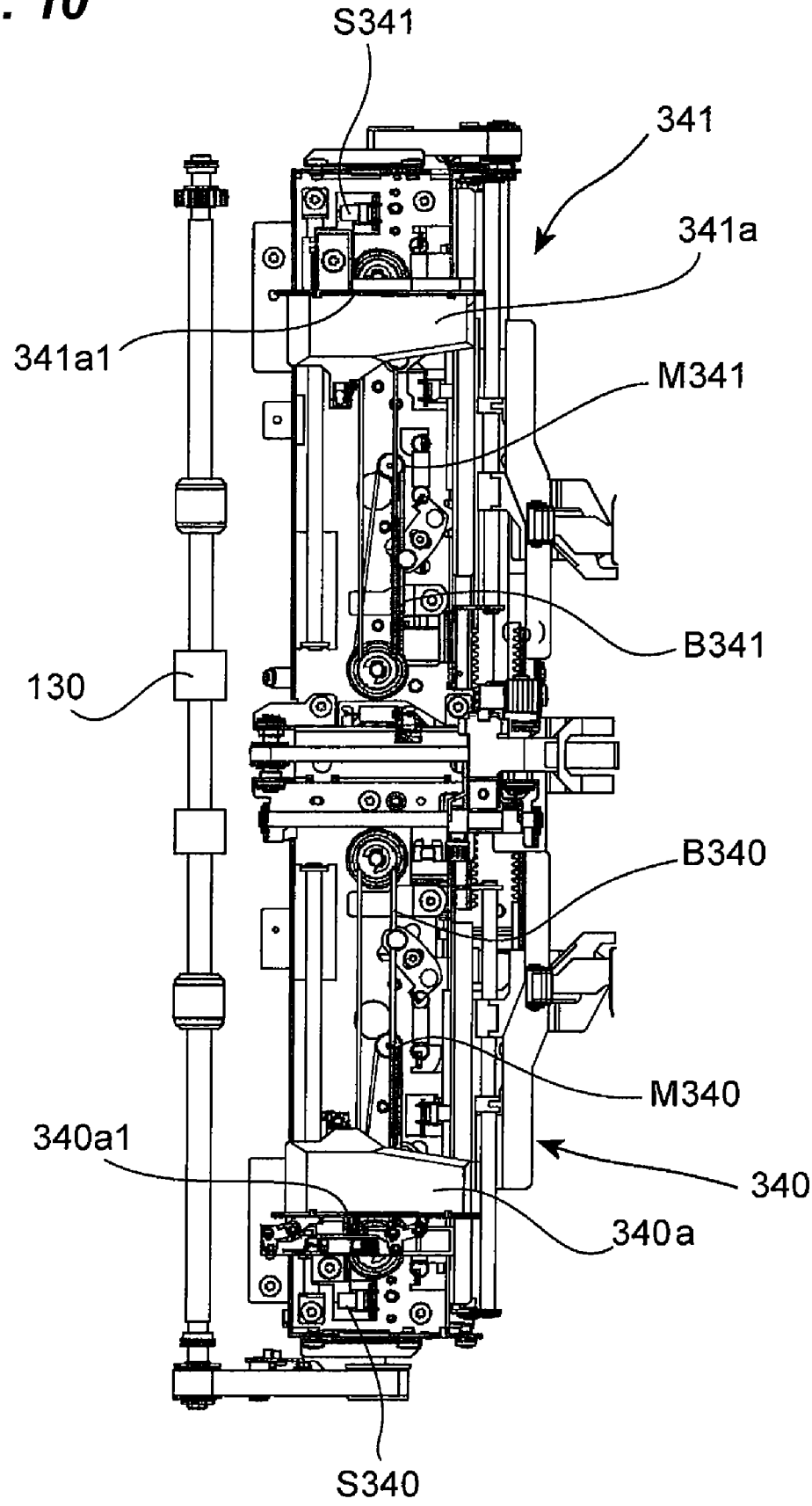
FIG. 10 is a top view describing discharging members.

As illustrated in FIG. 10, aligning members 340 and 341 have a first aligning member 340*a* and a second aligning member 341*a* which align the left and right end sides in the width direction of the sheet stored in the intermediate processing tray 138.

The first aligning member 340*a* and the second aligning member 341*a* are opposite on both ends of the sheet S on the surface of the intermediate processing tray 138 independently. The first aligning member 340*a* and the second aligning member 341*a* have aligning surfaces 340*a*1 and 341*a*1 which are perpendicular to the surface of the processing tray 138, and non-aligning surfaces which are in the upper portions thereof and each have an inclined surface on the outer side. The aligning surfaces 340*a*1 and 341*a*1 press and support the side end faces of the sheet.

The left and right aligning members 340 and 341 have a first driving motor M340 and a second driving motor M341 which can be driven independently. The first aligning member 340 and the second aligning member 341 are driven and transmitted from the end pulleys of the driving motors M340 and M341 via timing belts B340 and B341. The first aligning member 340 and the second aligning member 341 can be moved independently along the width direction of the sheet relative to the processing tray 138. The aligning surfaces 340*a*1 and 341*a*1 are opposite on the processing tray 138. The moving members are assembled on the lower surface side of the processing tray 138 so as to be moved forward and reversely in the aligning direction.

Sensors S340 and S341 which detect the home positions of the first aligning member 340*a* and the second aligning member 341*a* are arranged to the first aligning member 340*a* and the second aligning member 341*a*. When the finisher 100 is not operated, the first aligning member 340 and the second aligning member 341 are on standby in the home positions (or at both ends).

As illustrated in FIG. 8, a plurality of drawing-in paddles 131 are arranged above the intermediate processing tray 138 and are fixed along a driving shaft 157 rotated by a driving motor, not illustrated. The drawing-in paddles 131 are rotated counterclockwise in FIG. 8 by a driving motor M131 (not illustrated) with an appropriate timing. The drawing-in paddle 131 is a sheet conveying member which conveys a sheet and abuts it on the trailing end stopper 150. The plurality of drawing-in paddles 131 exist in the axial direction of the driving shaft 157.

The sheet trailing end aligning portion will be described. A belt roller 158 as the sheet conveying member and a trailing end lever 159 as the sheet pressing member are arranged on the upstream side of the intermediate processing tray 138.

The sheet is guided by the trailing end lever 159 by the counterclockwise rotation of the belt roller 158 and is then abutted on the trailing end stopper 150 so as to be aligned.

The pair of lower discharge rollers 128 serving as the conveying members consists of a discharge roller 128*a* and discharge roller 128*b*. The belt roller 158 is entrained on the outer circumference of a discharge roller 128*a* configuring the pair of lower discharge rollers 128 and is rotated counterclockwise following rotation of the discharge roller 128*a*. The belt roller 158 is provided above the intermediate processing tray 138 such that its lower portion is brought into contact with a topmost sheet stacked on the intermediate processing tray 138.

<Description of the Operation of the Aligning Members in a Non-Stapling Sort Mode>

Figure 12:
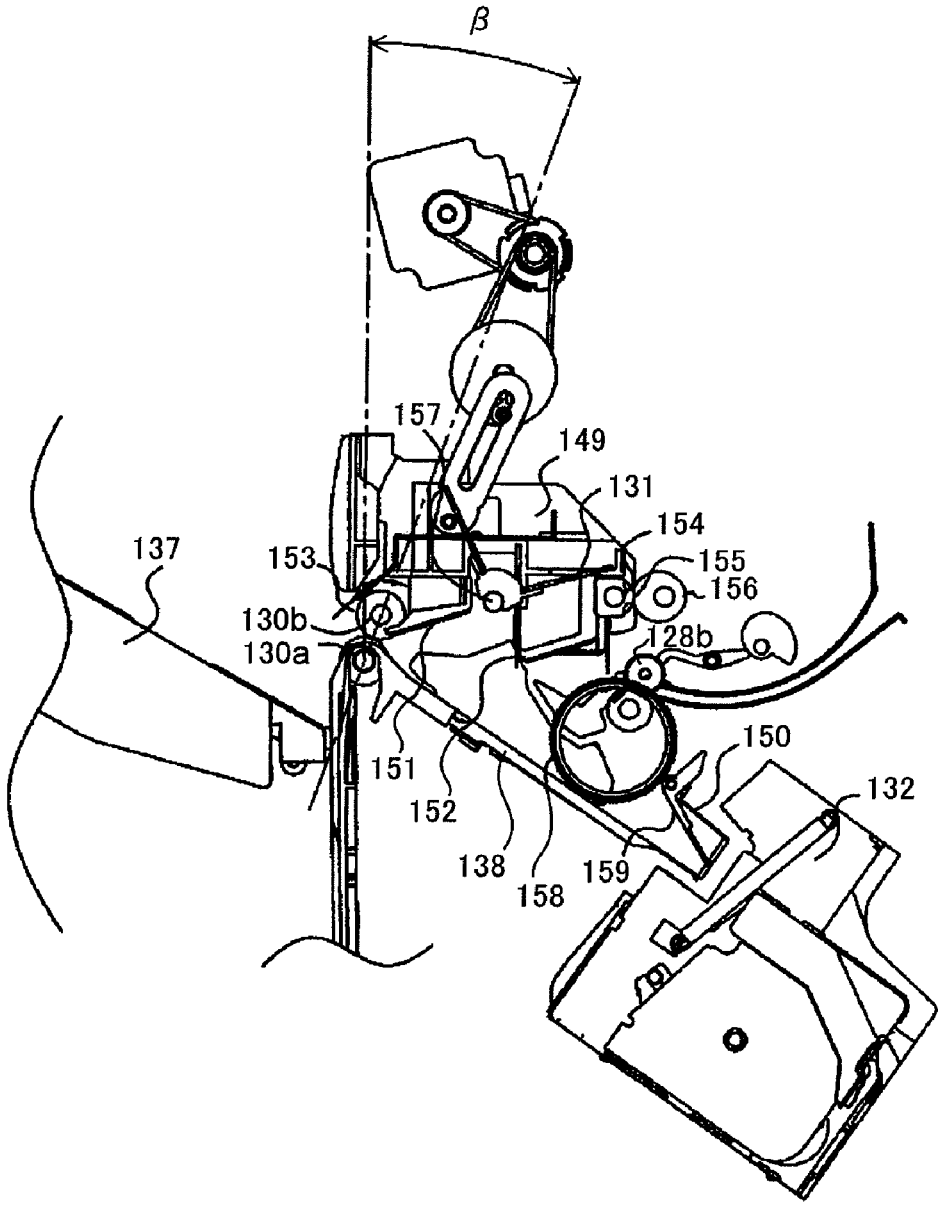
FIG. 12 is a diagram describing the flow of sheets and the operation of the intermediate processing tray in a non-stapling sort mode.

The flow of sheets and the operation of the pair of discharge rollers 130 as the discharging members in a non-stapling sort mode (or a first discharge mode) will be described using FIG. 12.

When the job in the non-stapling sort mode is selected, the eccentric cam 156 which is on standby in the home position is rotated 180° until the first sheet of the job is discharged from the image forming apparatus body 300. The abutment member 155 which forms the changing unit together with the eccentric cam 156 is slid to move the swinging guide 149 to the conveying downstream direction side.

The discharge angle changing operation by the changing unit is performed after the swinging guide 149 has been moved upward and the nip between the upper discharge roller 130*b* and the lower discharge roller 130*a* has been brought into the con-contact state. Abrasion due to rubbing between the surfaces of the rollers at the time of roller movement can be prevented.

When the discharge angle changing operation by the changing unit is completed, the swinging guide 149 is moved downward to bring the upper discharge roller 130*b* into contact with the lower discharge roller 130*a* so as to be on standby in the state of a discharge nip angle β relative to the vertical line.

The sheet discharged from the image forming apparatus is conveyed while being shifted by the shift unit 108 by a predetermined amount (to the front side in FIG. 2) and is then directly discharged from the pair of lower discharge rollers 128 to the upper discharge roller 130*b* and the lower discharge roller 130*a*. The sheet is discharged onto the lower discharge tray 137 by the pair of discharge rollers 130. The same operation is repeated for a specified number of sorted sheets. A second bundle is shifted by a predetermined amount to the opposite side of the shift direction of the first bundle (or to the back side in FIG. 2). As in the first bundle, the second bundle passes from the pair of lower discharge rollers 128 through the upper discharge roller 130*b* and the lower discharge roller 130*a* and is then discharged onto the lower discharge tray 137.

In this embodiment, the amount of one shift is set to 15 mm on one side from the center of discharge. The sheet bundle is shifted 30 mm as the amount of sort offset between the sheet bundles and is then stacked onto the lower discharge tray 137.

When a non-sort mode is specified, a lateral registration correction operation which returns the sheet conveyed so as to be shifted by slant conveying in the upstream portion to the discharge center position by the shift unit 108 is performed. The sheet passes through the upper discharge roller 130*b* and the lower discharge roller 130*a* in the discharge center position and is then discharged onto the lower discharge tray 137 as the stack tray.

In the non-stapling job, when each sheet is discharged onto the lower discharge tray 137, the discharge nip angle between the pair of discharge rollers 130 as the discharging members is β and the discharge direction is closer to the lower discharge tray 137 than that of the later-described sheet bundle discharge. The floating properties of the sheet after the trailing end of the sheet has passed through the pair of discharge rollers 130 can be stabilized. The leading end of the sheet is abutted on the stack tray quickly. The misalignment of the sheet can be prevented to improve the stacking properties. The prior art operation which reversely rotates the pair of discharge rollers 130 in the non-stapling sort mode to draw the sheet into the intermediate processing tray 138 is unnecessary. The deterioration of the apparatus due to abrasion and any operating noise can be suppressed.

<Description of the Operation of the Aligning Members in a Stapling Sort Mode>

The flow of sheets and the operation of the pair of discharge rollers 130 as the discharging members in a stapling sort mode (or a second discharge mode) will be described using FIGS. 13 to 17.

When the job in the stapling sort mode is selected, the eccentric cam 156 is rotated until the first sheet of the job is discharged from the image forming apparatus body 300. The abutment member 155 which forms the changing unit together with the eccentric cam 156 is slid to move the swinging guide 149 to the conveying upstream direction side (or in the opposite direction of the non-stapling sort mode).

Figure 13:
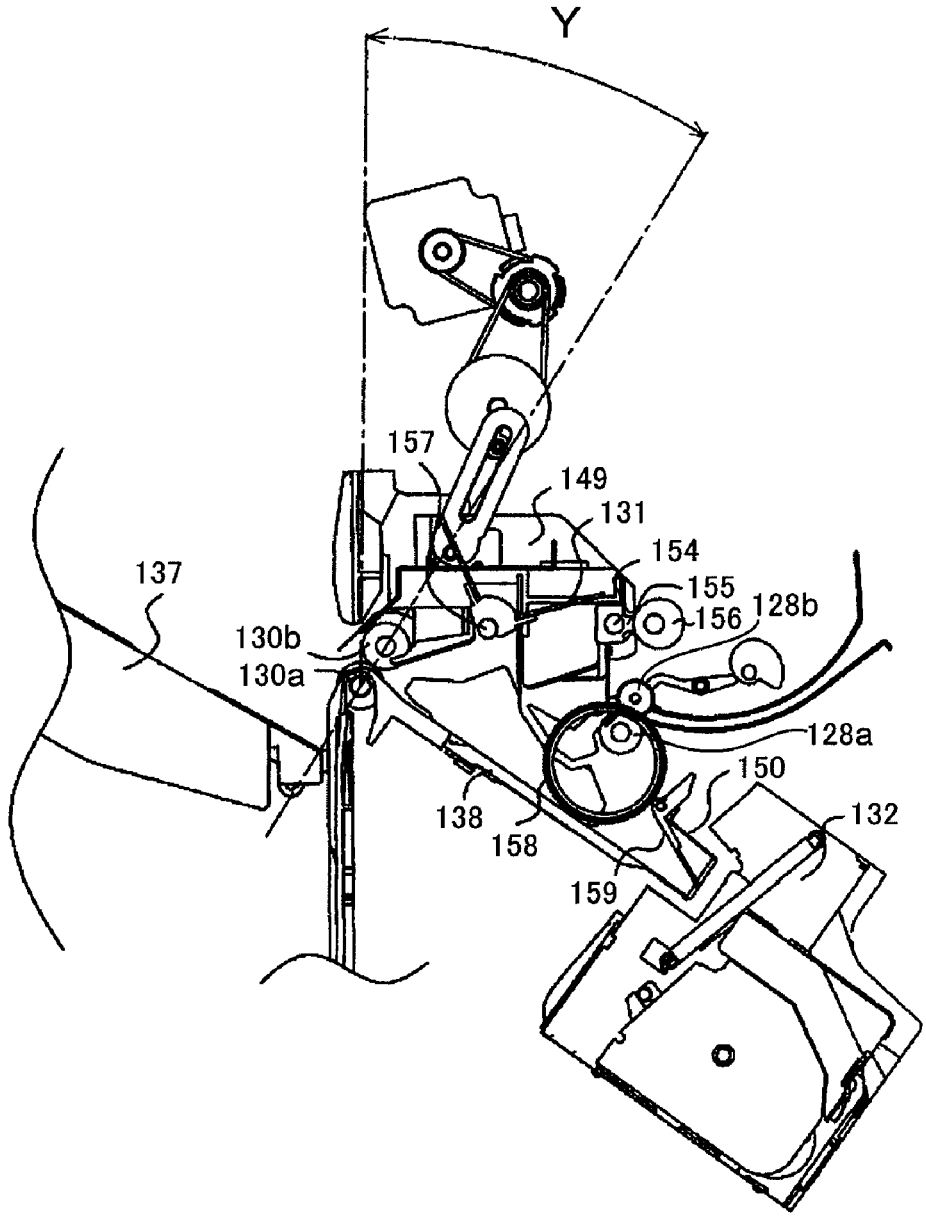
FIG. 13 is a diagram describing the flow of sheets and the operation of the intermediate processing tray in a stapling sort mode.

The discharge angle changing operation by the changing unit is performed after the swinging guide 149 has been moved upward and the nip between the upper discharge roller 130*b* and the lower discharge roller 130*a* has been brought into the non-contact state. As illustrated in FIG. 13, after the discharge angle changing operation has been completed, the swinging guide 149 is moved downward and brings the upper discharge roller 130*b* into contact with the lower discharge roller 130*a* so as to be on standby in the state of a discharge nip angle γ. The discharge angle at this time (or the discharge nip angle γ) is set to be larger (or in the direction away from the lower discharge tray 137) than the discharge angle (or the discharge nip angle β) in the non-stapling sort mode (or the first discharge mode) such that the discharge direction is directed upward (or in the direction away from the lower discharge tray 137).

A first sheet S11 of a first bundle discharged from the image forming apparatus body 300 is conveyed while being shifted by a predetermined amount in the front direction in FIG. 2 by the shift unit 108 and is then conveyed to the upper discharge roller 130*b* and the lower discharge roller 130*a* by the pair of lower discharge rollers 128.

Figure 14:
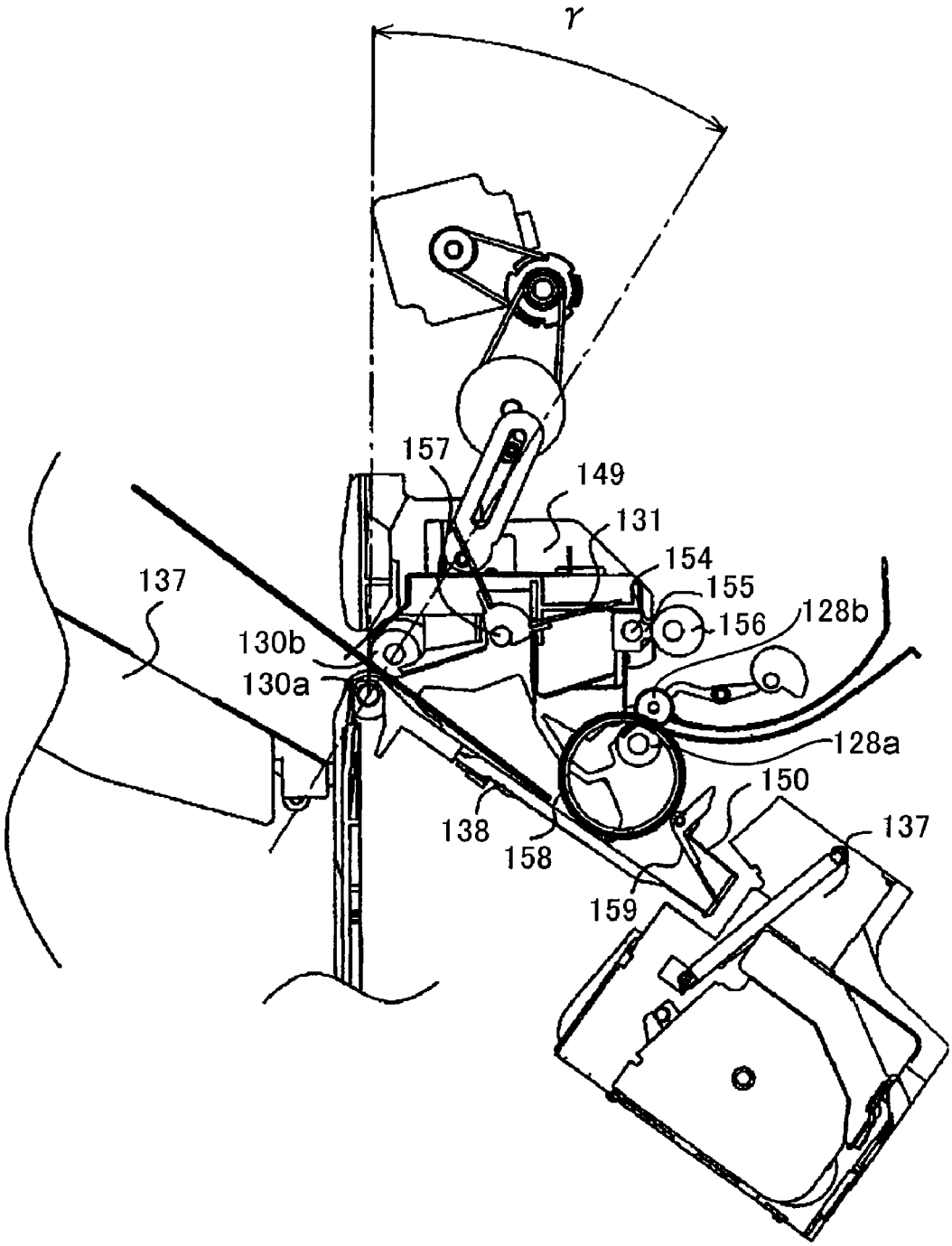
FIG. 14 is a diagram describing the flow of sheets and the operation of the intermediate processing tray in the stapling sort mode.

As illustrated in FIG. 14, the trailing end of the sheet S11 passes through the pair of lower discharge rollers 128. The sheet S11 is conveyed by a predetermined amount by the upper discharge roller 130*b* and the lower discharge roller 130*a*. The upper discharge roller 130*b* and the lower discharge roller 130*a* are reversely rotated. The sheet S11 is conveyed at a conveying speed Vb such that the trailing end of the sheet S11 is abutted on the trailing end stopper 150.

Figure 15:
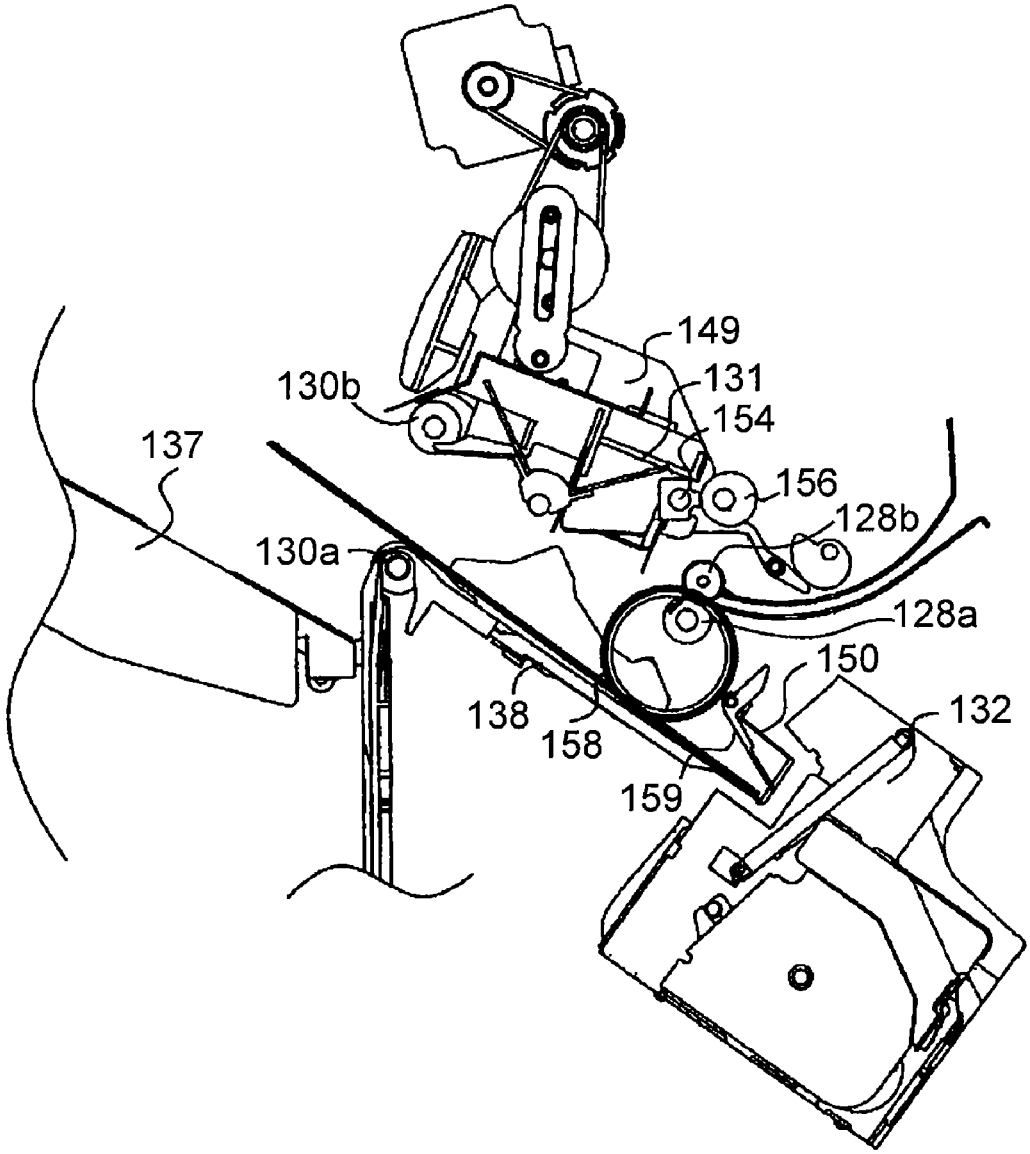
FIG. 15 is a diagram describing the flow of sheets and the operation of the intermediate processing tray in the stapling sort mode.

As illustrated in FIG. 15, before the trailing end of the sheet S11 is abutted on the trailing end stopper 150, the swinging guide 149 is raised to bring the upper discharge roller 130*b* out of contact with the lower discharge roller 130*a*. The sheet S11 conveyed at the conveying speed Vb can be aligned by being abutted on the trailing end stopper 150 in the non-nipped state. Buckling of a thin sheet which can be easily caused can be prevented.

The discharge direction of the upper discharge roller 130*b* and the lower discharge roller 130*a* is directed in the lower direction of the trailing end stopper 150 at reversal rotation. The trailing end of the sheet S11 can be reliably aligned by the trailing end stopper 150. An angle formed between the direction which connects each of the center points of the upper discharge roller 130*b* and the lower discharge roller 130*a* and the vertical direction is the discharge nip angle γ.

When aligning of the sheet S11 in the conveying direction (or at the trailing end thereof) is completed, aligning in the width direction is performed by the aligning members 340 and 341.

A second sheet S12 of a first bundle is discharged from the pair of lower discharge rollers 128 onto the intermediate processing tray 138. The swinging guide 149 is in the raising position. The sheet S12 is introduced in the state that the upper discharge roller 130*b* is brought out of contact with the lower discharge roller 130*a*. When the trailing end of the sheet S12 passes through the nip between the pair of lower discharge rollers 128, the sheet S12 is discharged onto the intermediate processing tray 138.

Figure 16:
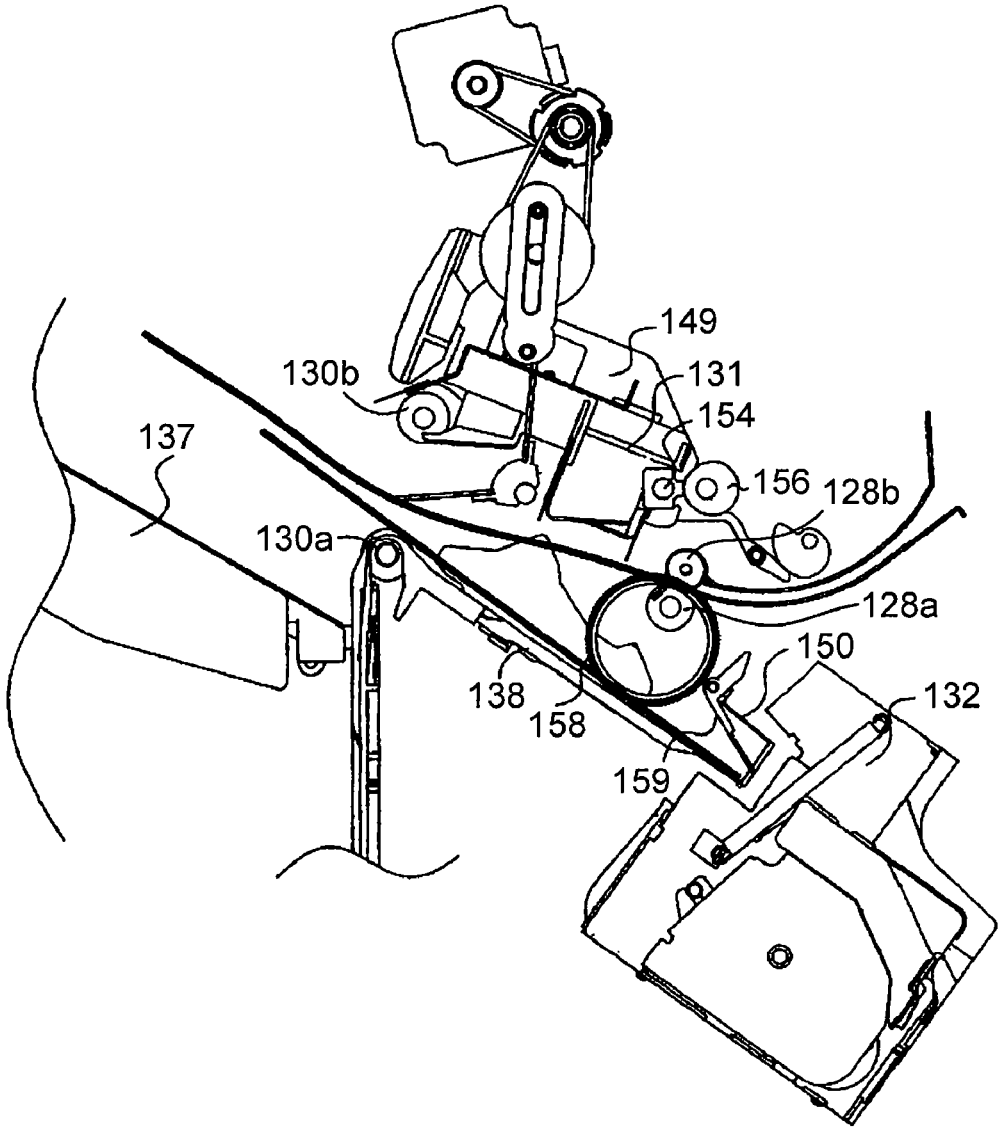
FIG. 16 is a diagram describing the flow of sheets and the operation of the intermediate processing tray in the stapling sort mode.

As illustrated in FIG. 16, the drawing-in paddles 131 are rotated counterclockwise. The sheet S12 discharged onto the intermediate processing tray 138 is conveyed such that the trailing end of the sheet S12 is directed to the trailing end stopper 150.

The sheet S12 is drawn into the trailing end stopper 150 by the belt roller 158 rotated counterclockwise, is abutted on the surface of the trailing end stopper 150, and is aligned. When aligning of the sheet S12 in the conveying direction (or at the trailing end thereof) is completed, aligning in the width direction is performed by the aligning members 340 and 341 as in the first sheet. A series of operation is repeated until a last sheet S1*n* of the first bundle is abutted on the trailing end stopper 150.

Figure 17:
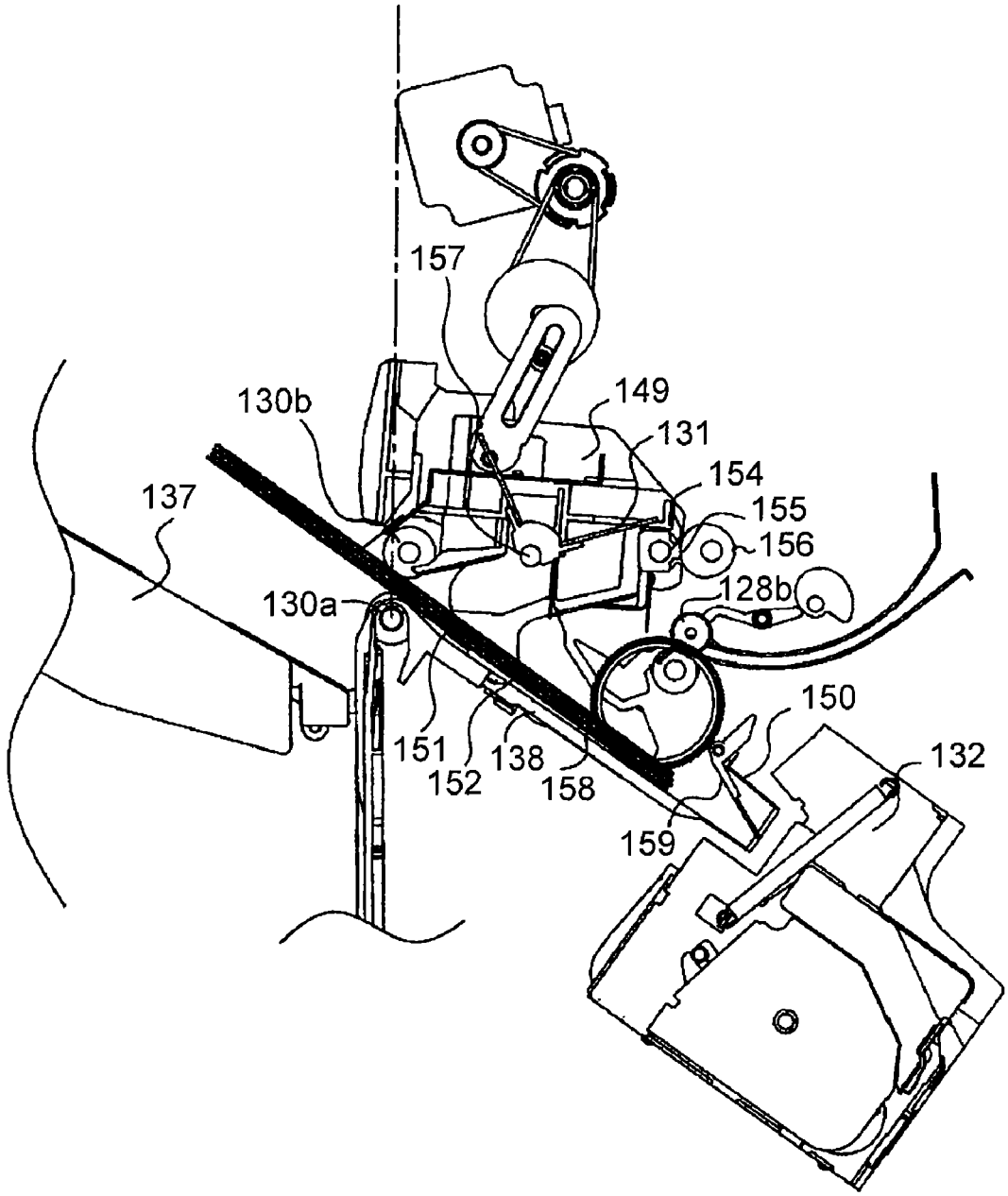
FIG. 17 is a diagram describing the flow of sheets and the operation of the intermediate processing tray in the stapling sort mode.

When the aligning operation of the last sheet S1*n* is completed, the trailing end of a sheet bundle S1T is stapled and clinched by the stapler 132. As illustrated in FIG. 17, the swinging guide 149 is lowered and the sheet bundle S1T is nipped between the upper discharge roller 130*b* and the lower discharge roller 130*a* so as to be discharged onto the lower discharge tray 137.

The stapling operation after the last sheet S1*n* has been abutted on the trailing end stopper 150 and the operation which discharges the sheet bundle onto the lower discharge tray 137 require the processing time longer than the typical sheet process. The sheet, that is, a first sheet S21 of a second bundle cannot be introduced into the intermediate processing tray 138 during that time.

As described above, in the sheet processing apparatus of this embodiment, the sheet discharged from the image forming apparatus body 300 is buffered (or reserved) during that time. The sheet of the next bundle is sequentially received from the image forming apparatus body 300. No sheets are discharged onto the intermediate processing tray 138.

Figure 18:
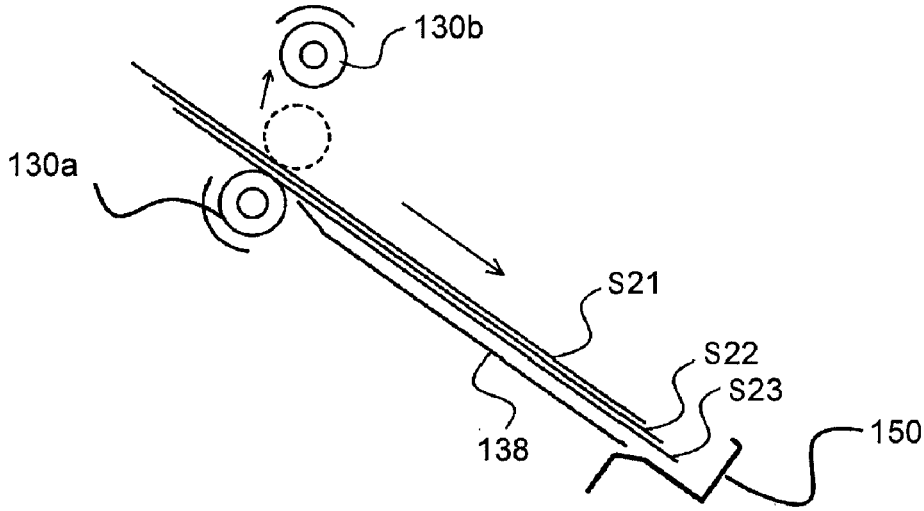
FIG. 18 is an operation diagram describing buffer sheet aligning.

As illustrated in FIG. 18, the three sheets S21, S22, and S23 of the second bundle buffered before the first sheet bundle is discharged onto the lower discharge tray 137 are imbricately overlapped. A bundle of the buffered sheets S21 to S23 is conveyed from the pair of lower discharge rollers 128 to the upper discharge roller 130*b* and the pair of lower discharge rollers 130*a*. The bundle of the three sheets is conveyed by a predetermined amount by the upper discharge roller 130*b* and the lower discharge roller 130*a* after its trailing end has passed through the pair of lower discharge rollers 128. As in the first sheet of the first bundle, the upper discharge roller 130*b* and the lower discharge roller 130*a* are reversely rotated. The sheet bundle is conveyed at the conveying speed Vb in the direction in which the trailing end of the sheet bundle is abutted on the trailing end stopper 150.

Before the trailing end of the sheet bundle is abutted on the trailing end stopper 150, the swinging guide 149 is raised to bring the upper discharge roller 130*b* out of contact with the lower discharge roller 130*a*. As in the first bundle, the fourth sheet to the last sheet of the second bundle are aligned and stapled and are then discharged onto the lower discharge tray 137. After the operation has been repeated for a specified number of bundles, the job is completed.

(Controlling Portions)

Figure 19:
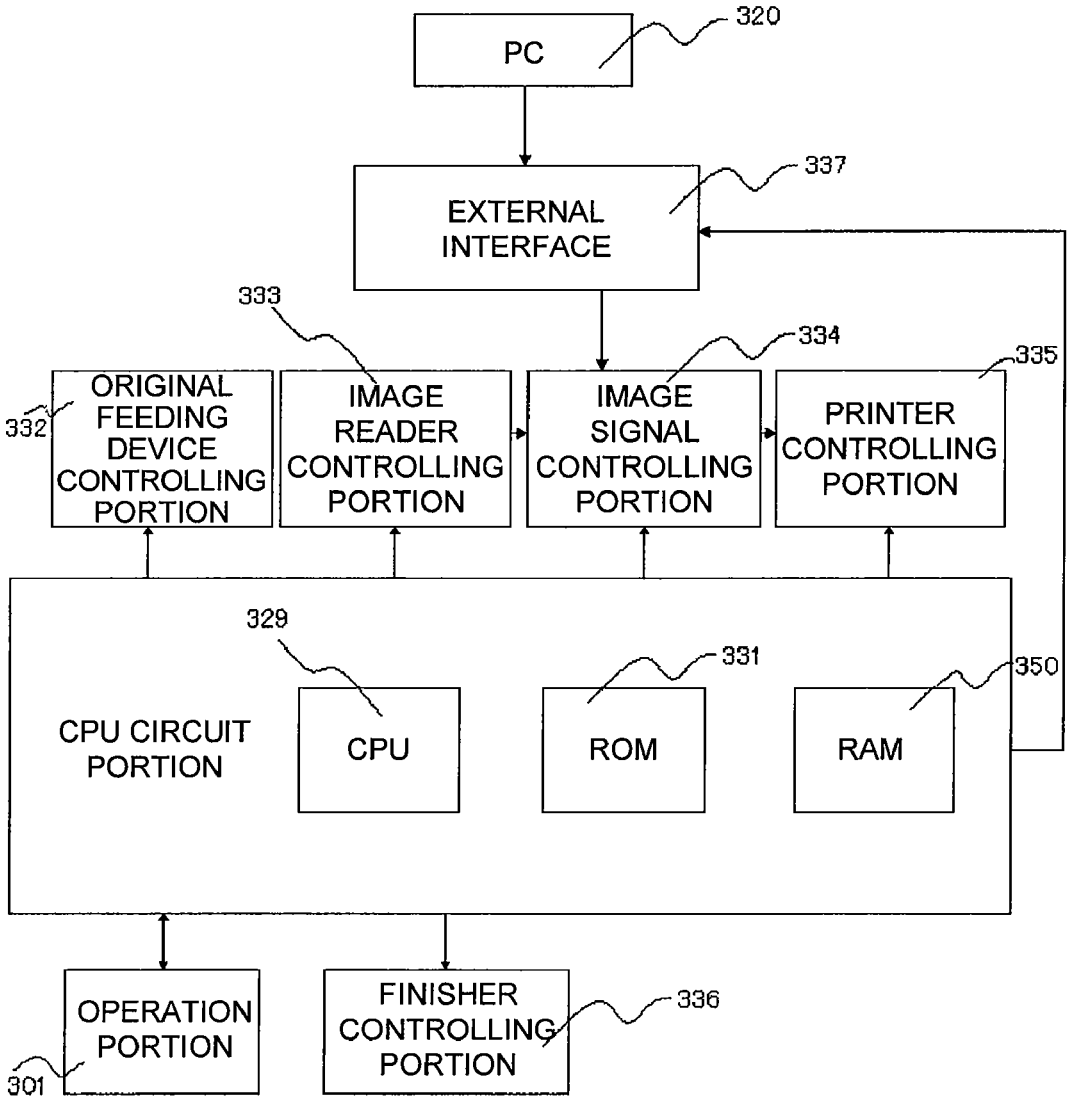
FIG. 19 is a block diagram of controlling portions of the image forming apparatus which control the image forming apparatus.

FIG. 19 is a block diagram of controlling portions of an image forming apparatus which control the image forming apparatus. As illustrated in FIG. 19, a CPU circuit portion 330 has a CPU 329, a ROM 331, and a RAM 350. The CPU circuit portion 330 controls an original feeding device controlling portion 332, an image reader controlling portion 333, an image signal controlling portion 334, a printer controlling portion 335, a finisher controlling portion 336, and an external interface 337. The CPU circuit portion 330 controls them according to setting of a program stored in the ROM 331 and the operation portion 301.

The original feeding device controlling portion 332 controls an original feeding device 500. The image reader controlling portion 333 controls an image reader. The printer controlling portion 335 controls the image forming apparatus body 300. The finisher controlling portion 336 controls the finisher 100. In this embodiment, the finisher controlling portion 336 is mounted on the finisher 100. The finisher controlling portion 336 may be provided in the image forming apparatus body 300 so as to be integral with the CPU circuit portion 330 and may control the finisher 100 from the image forming apparatus body 300.

The RAM 350 is used as an area which temporarily holds control data and a working area of computation with control. The external interface 337 is an interface from a computer 320 and develops print data to an image to output it to the image signal controlling portion 334. The image read by the image sensor is outputted from the image reader controlling portion 333 to the image signal controlling portion 334. The image outputted from the image signal controlling portion 334 to the printer controlling portion 335 is inputted to an exposure controlling portion.

Figure 20:
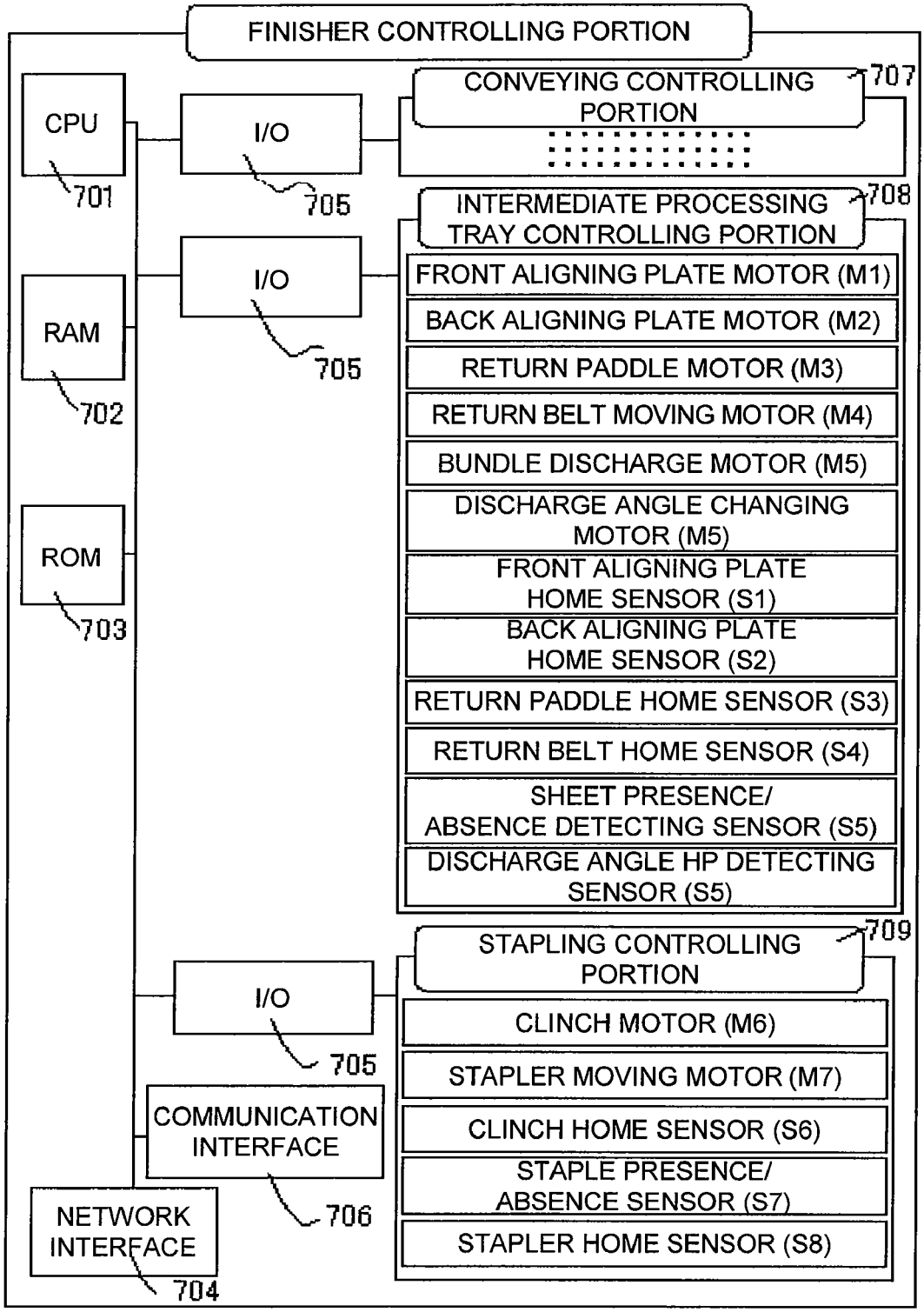
FIG. 20 is a block diagram of the controlling portion which controls the sheet processing apparatus.

FIG. 20 is a block diagram of the finisher controlling portion 336 which controls the finisher 100. As illustrated in FIG. 20, the finisher controlling portion has a microcomputer (CPU) 701, a RAM 702, a ROM 703, an input/output portion (I/O) 705, a communication interface 706, and a network interface 704.

A conveying controlling portion 707 performs the sheet lateral registration detecting process, the sheet buffering process, and the conveying process. In an intermediate processing tray controlling portion 708, the operation control of the aligning plates, the operation control of the paddles, the moving control of the belt roller, the bundle discharge control, and the discharge angle moving control are controlled by the home position detecting sensor and the moving motor. In a stapling controlling portion 709, the staple moving control and the clinch control are controlled by the home sensor and the motor.

Various sensor signals are inputted to the input port of the I/O 705. The output port of the I/O 705 is connected to the driving systems connected to the control block, not illustrated, and various drivers, not illustrated.

(Sheet Discharge Control)

Figure 21:
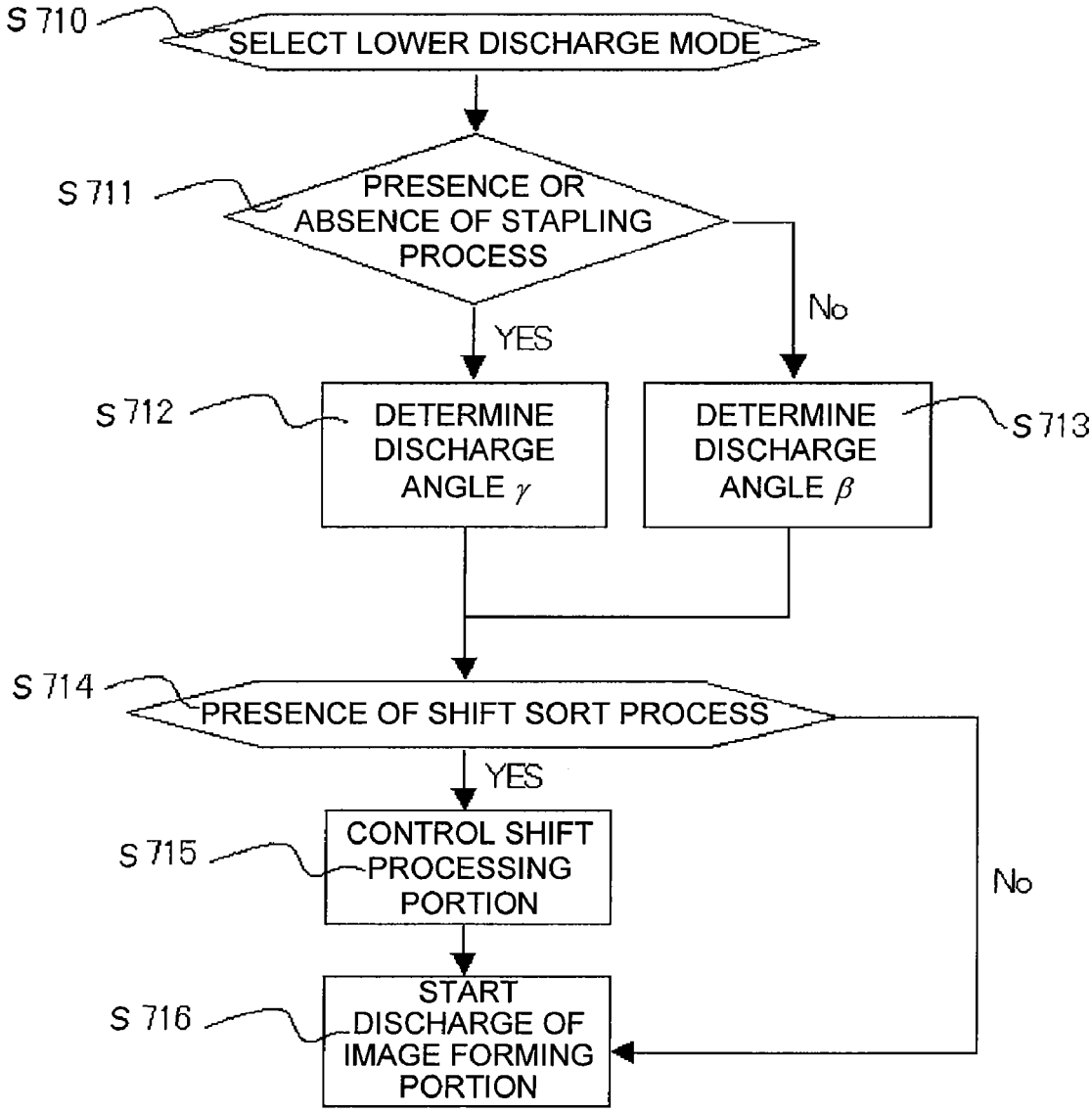
FIG. 21 is a flowchart of sheet discharge control.

FIG. 21 is a flowchart of sheet discharge control. As illustrated in FIG. 21, when the discharge position is selected to the lower discharge tray 137 (S710), the apparatus is brought into the presence or absence judgment mode of the stapling process (S711). When the stapling process is performed, the discharge nip angle between the pair of discharge rollers 130 as the aligning members is set to γ relative to the vertical line (S712). In the non-stapling process, the discharge nip angle between the pair of discharge rollers 130 is set to β smaller than γ relative to the vertical line (S713).

The presence or absence judgment of the shift sort process is performed (S714). When the shift sort mode is selected, the shift unit 108 is controlled (S715) to start the sheet discharge operation from the image forming portion (S716). In the absence of the shift sort process, the sheet discharge operation from the image forming portion is started without controlling the shift unit 108 (S716).

(Effects)

Figure 22:
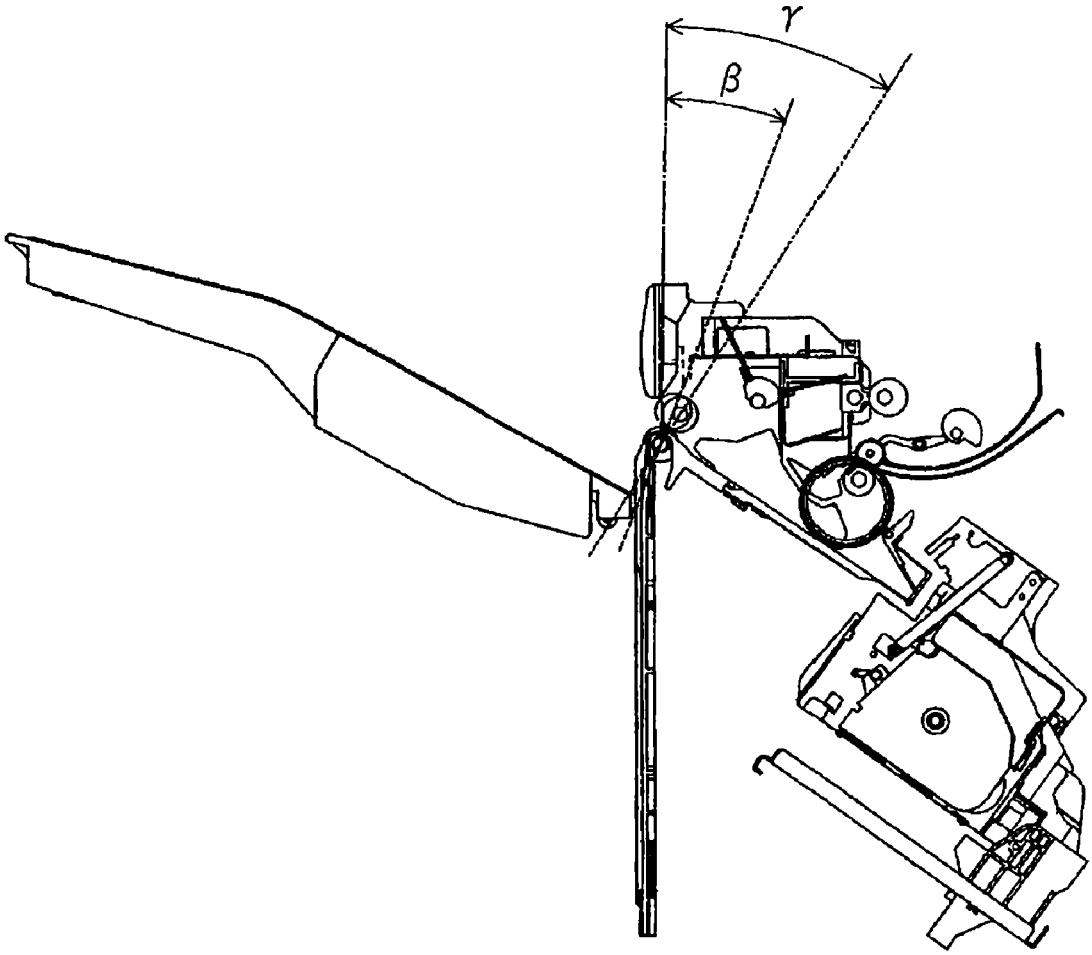
FIG. 22 is a comparison diagram of discharge nip angles.

As illustrated in FIG. 22, in the case of the non-stapling sheet process (or the first discharge mode), the discharge nip angle between the pair of discharge rollers 130 is β and the discharge direction is directed toward the lower discharge tray 137 as compared with when the discharge nip angle at bundle discharge is γ (or in the first discharge direction). Each sheet in the state of maintaining a stable posture can be discharged onto the lower discharge tray 137 without lowering the productivity.

In the case of the stapling process (or the second discharge mode), the discharge nip angle between the pair of discharge rollers 130 is γ and the discharge direction is directed in the direction away from the lower discharge tray 137 as compared with when the discharge nip angle is β (or in the second discharge direction). Even when a bundle of a large number of sheets is discharged at one time, it cannot block the discharge port. At reversal rotation, the discharge direction is directed in the direction of the lower portion of the trailing end stopper 150. The aligning properties of a bundle of a plurality of buffered sheets can thus be secured. The plurality of sheets are always discharged onto the lower discharge tray 137. The stacking properties on the lower discharge tray 137 cannot be lowered.

In this embodiment, the discharge direction of the pair of discharge rollers 130 is directed upward relative to the horizontal plane in both the non-stapling process and the stapling process. When the first discharge direction in the non-stapling process is closer to the stack tray than the second discharge direction in the stapling process, the discharge direction of the pair of discharge rollers 130 may be directed downward relative to the horizontal plane. The discharge angle of the pair of discharge rollers 130 is preferably changed according to the sheet size, the conveying length, the curled state, the basis weight (ream weight), the thickness, the image forming density, the apparatus use environment, and the folding form.

Figure 23:
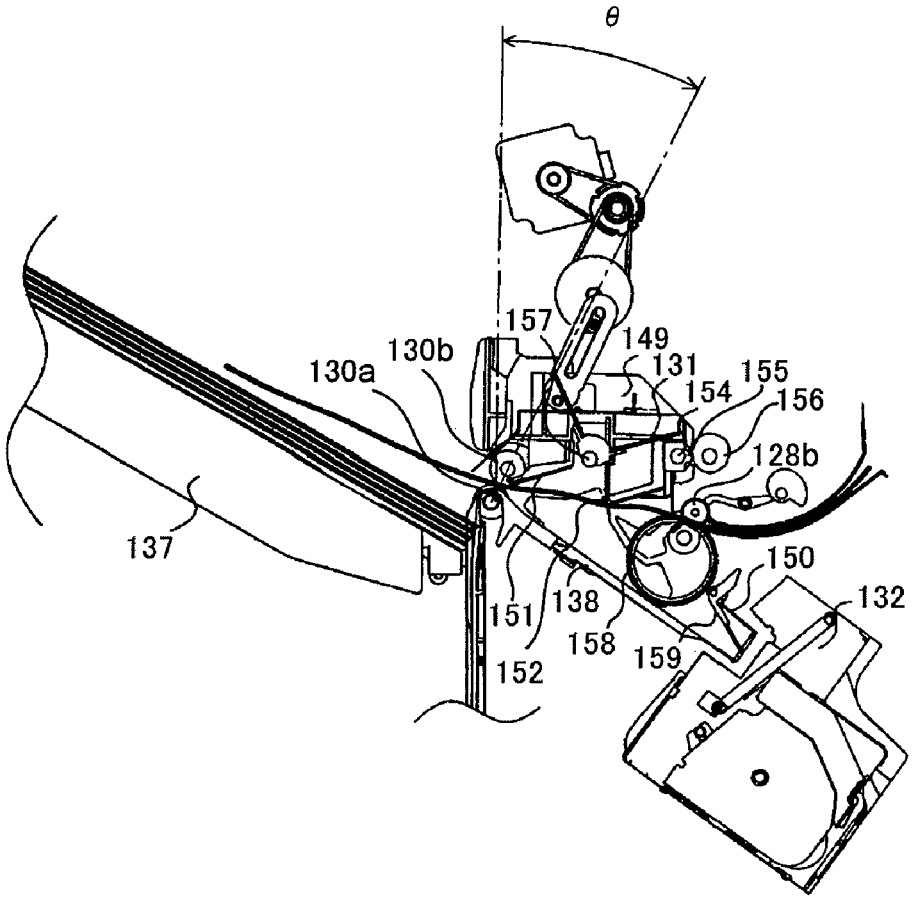
FIG. 23 is a description diagram of a discharge nip angle.
Figure 24:
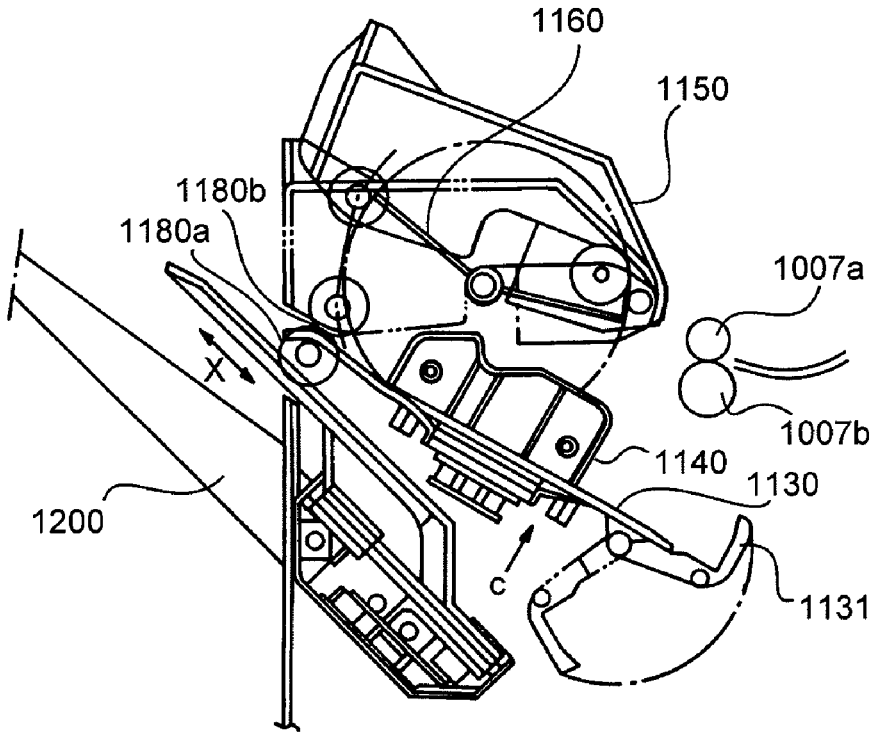
FIG. 24 is a cross-sectional view describing a sheet processing apparatus in a related art.

There will be described the operation of the pair of discharge rollers 130 when a sheet having a large size and a long conveying length or a heavy sheet having high surface resistance such as a coat sheet is discharged without being stapled. As illustrated in FIG. 23, when the sheet having a large size and a long conveying length or the coat sheet is discharged, the mass of the discharged sheet itself is large. The sheet discharge distance from the pair of discharge rollers 130 at sheet discharge is shortened. The trailing end of the sheet tends to be sagged. There can be easily caused the phenomenon in which the leading end of the sheet at discharge pushes out the sheet which has been discharged onto the stack tray in the conveying direction to disturb the stacking state.

The rotational position of the eccentric cam 156 as the changing unit is changed to set the discharge nip angle between the pair of discharge rollers 130 to θ relative to the vertical line larger than the discharge nip angle β in the normal non-stapling mode (or the first discharge mode). As compared with when the discharge nip angle is β, the discharge direction of the sheet can be directed slightly upward (or in the direction away from the lower discharge tray 137). The sagging of the trailing end of the sheet and the pushout of the stacked sheet by the leading end of the sheet can be prevented. When the curl direction is directed downward, the basis weight and the sheet thickness are large, the image forming density is high, the humidity of the use environment is high, and the folded sheet is discharged, the discharge direction is preferably directed slightly upward in substantially the same manner. A wide range of types and sizes of sheets, higher speed, and the curl direction and size of the sheet in a wide use environment can be coped with. The discharge nip angle θ at this time can be set to an arbitrary angle between β and γ.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-289201, filed Nov. 7, 2007, which is hereby incorporated by reference herein in its entirety.

What is claimed is:

1. A sheet discharge apparatus comprising:

a first stack tray which stacks sheets thereon;

a pair of discharge rollers which discharges a sheet onto the first stack tray and which is adapted to convey the sheet in an opposite direction from a discharge direction of the sheet;

a conveying member which conveys the sheets to the pair of discharge rollers;

a second stack tray on which the pair of discharge rollers conveys the sheets in the opposite direction from the discharge direction to overlap the sheet;

an end stopper on which the sheet conveyed in the opposite direction by the pair of discharge rollers is abutted to align;

a changing unit which changes a discharge angle of the pair of discharge rollers; and a control unit which changes the discharge angle of the pair of discharge rollers by the changing unit such that a first discharge direction in a first discharge mode which discharges sheets one by one is closer to the first stack tray than a second discharge direction in a second discharge mode which discharges a plurality of overlapped sheets on the first stack tray from the second stack tray at one time, wherein the opposite direction from the second discharge direction is set to direct sheets to a lower position of the end stopper at reversal rotation of the pair of discharge rollers.

2. The sheet discharge apparatus according to claim 1, wherein:

the first discharge mode is a mode which directly discharges a conveyed sheet by the conveying member onto the first stack tray by the pair of discharge rollers, and the second discharge mode is a mode which stacks the sheet conveyed by the conveying member on the second stack tray by reversely rotating the pair of discharge rollers and discharges the sheet onto the first stack tray.

3. The sheet discharge apparatus according to claim 1, wherein the discharge angle of the in pair of discharge rollers the first discharge mode is changed according to a sheet size, a conveying length, a curl state, a basis weight, a thickness, a image forming density, an apparatus use environment, and a folding form.

4. The sheet discharge apparatus according to claim 1, wherein the pair of discharge rollers has a pair of discharge rollers including a plurality of discharge rollers, and the changing unit changes the discharge angle by changing a discharge nip angle between the pair of discharge rollers.

5. The sheet discharge apparatus according to claim 4, wherein the changing unit changes the discharge angle by moving at least one of the pair of discharge rollers and changing the discharge nip angle between the pair of discharge rollers.

6. The sheet discharge apparatus according to claim 5, wherein the changing unit moves at least one of the pair of discharge rollers which are brought out of contact with each other to change the discharge nip angle between the pair of discharge rollers.

7. The sheet discharge apparatus according to claim 4, wherein the pair of discharge rollers are rotationally driven from a driving member.

8. The sheet discharge apparatus according to claim 4, further comprising:

a guide which is provided on an upstream side in a sheet conveying direction of at least one of the discharge rollers and guides a conveyed sheet to the pair of discharge rollers; and a charge removal member which is provided on the upstream side in the sheet conveying direction of the at least one discharge roller and removes a charged electrical potential on a surface of the sheet, wherein the changing unit changes the discharge angle of the pair of discharge rollers so as not to change the arrangement relation between the guide, the charge removal member, and the at least one discharge roller.

9. A sheet processing apparatus comprising:

a sheet processing portion which processes a sheet;

a first stack tray which stacks sheets processed by the sheet processing portion thereon;

a pair of discharge rollers which discharges the sheets onto the stack tray and which is adapted to convey the sheet in an opposite direction from a discharge direction of the sheet;

a conveying member which conveys the sheets to the pair of discharge rollers;

a second stack tray on which the pair of discharge rollers conveys the sheets in the opposite direction from the discharge direction to overlap the sheet;

an end stopper on which the sheet conveyed in the opposite direction by the pair of discharge rollers is abutted to align;

a changing unit which changes a discharge angle of the pair of discharge rollers, and a control unit which changes the discharge angle of the pair of discharge rollers by the changing unit such that a first discharge direction in a first discharge mode which discharges sheets one by one is closer to the first stack tray than a second discharge direction in a second discharge mode which discharges a plurality of on the first stack tray from the second stack tray at one time, wherein the opposite direction from the second discharge direction is set to direct sheets to a lower position of the end stopper at reversal rotation of the pair of discharge rollers.

10. An image forming apparatus comprising:

an image forming portion which forms an image on a sheet;

a sheet processing portion which processes the sheet;

a first stack tray which stacks sheets processed by the sheet processing portion thereon;

a pair of discharge rollers which discharges the sheets onto the first stack tray and which is adapted to convey the sheet in an opposite direction from a discharge direction of the sheet;

a conveying member which conveys the sheets to the pair of discharge rollers;

a second stack tray on which the pair of discharge rollers conveys the sheets in the opposite direction from the discharge direction to overlap the sheets;

an end stopper on which the sheet conveyed in the opposite direction by the pair of discharge rollers is abutted to align;

a changing unit which changes a discharge angle of the pair of discharge rollers, and a control unit which changes the discharge angle of the discharging member by the changing unit such that a first discharge direction in a first discharge mode which discharges sheets one by one is closer to the first stack tray than a second discharge direction in a second discharge mode which discharges a plurality of overlapped sheets to the first stack tray from the second stack tray at one time, wherein the opposite direction from the second discharge direction is set to direct sheets to a lower position of the end stopper at reversal rotation of the pair of discharge rollers.

11. An image forming apparatus comprising:

an image forming portion which forms an image on a sheet;

a first stack tray which stacks sheets thereon;

a pair of discharge rollers which discharges the sheets onto the first stack tray and which is adapted to convey the sheet in an opposite direction from a discharge direction of the sheet;

a conveying member which conveys the sheets to the pair of discharge rollers;

a second stack tray on which the pair of discharge rollers conveys the sheets in the opposite direction from the discharge direction to overlap the sheets;

a changing unit which changes a discharge angle of the pair of discharge rollers; and a control unit which changes the discharge angle of the pair of discharge rollers by the changing unit such that a first discharge direction in a first discharge mode which discharge sheets one by one is closer to the first stack tray than a second discharge direction in a second discharge mode which discharges a plurality of overlapped sheets on the first stack tray from the second stack tray at one time, wherein the opposite direction from the second discharge direction is set to direct sheets to a lower position of the end stopper at reversal rotation of the pair of discharge rollers.

* * * * *